United States Patent [19]

Oishi

[11] 3,993,488

[45] Nov. 23, 1976

[54] PHOTOGRAHIC FILM ASSEMBLY COMPRISING LIGHT INTERCEPTING ELEMENTS LOCATED BEHIND PRESSURE PLATE

[75] Inventor: Yasushi Oishi, Kanagawa, Japan

[73] Assignee: Fuji Photo Film Co., Ltd., Minami-ashigara, Japan

[22] Filed: Aug. 14, 1974

[21] Appl. No.: 498,005

[30] Foreign Application Priority Data

Aug. 14, 1973 Japan ..... 48-91049

[52] U.S. Cl. ..... 96/76 C; 96/77; 96/201; 354/304

[51] Int. Cl.[2] ..... G03C 1/48; G03C 1/40; G03D 9/02

[58] Field of Search ..... 96/76 C, 77, 201; 354/304

[56] References Cited

UNITED STATES PATENTS 3,745,900 7/1973 Nerwin ..... 96/76 C 3,765,887 10/1973 Rogers ..... 96/76 C

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A photographic film assembly, which contains a plurality of light-sensitive sheets stacked in a planar parallel relationship between the front wall of a film container having a rectangular opening for exposure and a pressure plate in a planar parallel relationship with the front wall, each of the light-sensitive sheets comprising a transparent support having thereon, in sequence, at least one silver halide light-sensitive emulsion layer and an light-intercepting layer of a hydrophilic colloid containing a light absorbent in an amount necessary for preventing, upon exposure, a next light-sensitive sheet lying behind in the direction of exposure from being fogged, and each of the light-sensitive sheets being retained in the container with the support being directed toward the exposure opening.

14 Claims, 8 Drawing Figures

PHOTOGRAHIC FILM ASSEMBLY COMPRISING LIGHT INTERCEPTING ELEMENTS LOCATED BEHIND PRESSURE PLATE

BACKGROUND OF THE INVENTION

1. Field of the Invention

The present invention relates to a photographic material and, more particularly, it relates to a photographic film assembly which permits, immediately after photographing, the photographic light-sensitive materials exposed in a camera to be withdrawn one by one into a bright place.

2. Description of the Prior Art

A photographic method has long been desired which enables a number of light-sensitive sheets to be loaded at one time in a camera, which enables continuous exposure to be conducted and which enables the light-shielded light-sensitive sheets to be withdrawn one by one out of a camera after each exposure to process the sheets in a bright place as such. However, satisfactory methods have not yet been developed.

With the light-intercepting method employed for many conventional light-sensitive materials, it has been difficult, until all of the sheets are exposed, to withdraw and develop loaded and exposed light-sensitive sheets in a camera without loss of the remaining light-sensitive materials. Therefore, a long time interval exists between the photographing and utilization of photographic images, which limits the usefulness of photographic recording. On the other hand, a method of loading individual light-sensitive materials such as cut-films to achieve the property of instantly obtaining photographic images has been applied only to special uses due to the troublesome procedure of frequently changing the light-sensitive materials. Also, in order to withdraw the exposed light-sensitive sheet into a bright place, it is necessary to shield both sides of the sheet from light to protect the light-sensitive layer from ambient light. Several methods for intercepting light or shielding from light are known.

In addition, in order to expose only one of a number of light-sensitive sheets loaded in a camera, a method of shifting the light-sensitive sheets one by one to a position in a camera for exposure or a method of exposing a stack of the sheets is known. The former method requires a comparatively complicated mechanism and space for shifting the light-sensitive sheets, whereas the latter method requires a light-intercepting means between the light-sensitive sheets in order to prevent ghost images from being formed in a second, third or like sheet.

These technical problems relating to interception of light can partly be solved by using a light-intercepting support for the light-sensitive sheet. However, light-sensitive sheets having a second light-intercepting substance coated on the surface of the light-sensitive layer are difficult to process in a processing bath independent of a camera. Furthermore, a non-delamination type diffusion transfer material using a light-sensitive sheet having a light-intercepting support has the defect that a complicated light-intercepting layer which finally becomes the white background of images and a camera having a complicated geometric reversal machanism as an optical system are required as an optical system are required.

SUMMARY OF THE INVENTION

An object of the present invention is to provide a photographic film assembly which enables exposure of a stack of a number of light-sensitive sheets at a focal position of a camera with good planarity to be conducted without formation of ghost images.

Another object of the present invention is to provide a photographic film assembly which enables an exposed light-sensitive sheet to be withdrawn, after exposure of the sheet, out of a camera in a state in which the sheet is shielded from light.

A further object of the present invention is to provide a photographic film assembly which enables a film unit, withdrawn out of a camera in a state shielded from light, to be development processed as such in a bright place.

Still a further object of the present invention is to provide a film assembly which can be used in a camera having an ordinary geometric optical system and which enables diffusion transfer film units capable of being processed in a bright place outside a camera and not requiring delamination of an image-receiving element to be provided.

Still another object of the present invention is to provide a film assembly which enables a conventional development-type light-sensitive material and a diffusion transfer light-sensitive material to be used in combination.

These and other objects of the present invention will become apparent from the following detailed description and Examples of the invention.

It has now been found that the above-described objects can be attained by a photographic film assembly which comprises a plurality of light-sensitive sheets piled in a planar parallel relationship between the front wall of a film container having a rectangular opening for exposure and a pressure plate the plane of which is parallel with the front wall of the film container, each of the light-sensitive sheets comprising a transparent support having thereon, in sequence, a silver halide emulsion layer or layers and an light-intercepting layer of a hydrophilic colloid containing a light absorbent in an amount sufficient for preventing, upon exposure, the next light-sensitive sheet lying behind from being fogged, and each of the light-sensitive sheets being retained in the container with the transparent support being directed toward the exposure opening.

The film assembly of the present invention preferably possesses, in addition, a light-intercepting sheet to cover the support surface of an exposed light-sensitive sheet between a pressure plate and a rear wall of a film container, the light-intercepting sheet having substantially the same size as that of the light-sensitive sheet and having the absorbance necessary to protect the light-sensitive layer from ambient light in a bright place outside a camera.

DETAILED DESCRIPTION OF THE INVENTION

Figure 1:
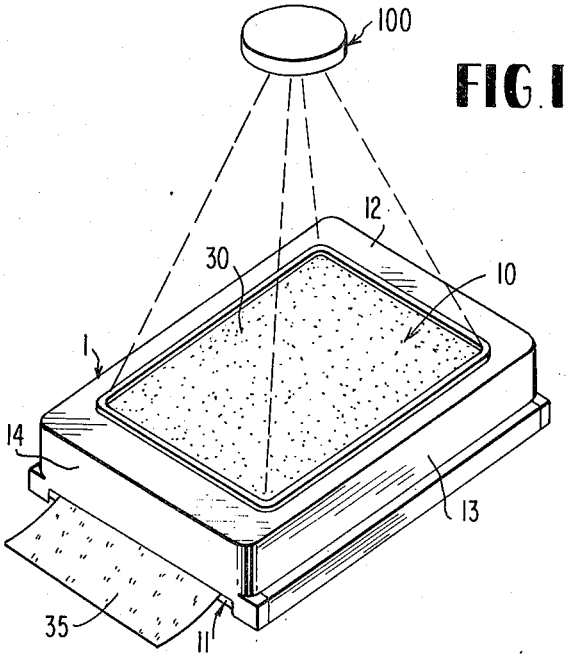
FIG. 1 shows the external appearance of the film assembly of the present invention from the side to be exposed.

Silver halide light-sensitive layers to be contained in the film assembly of the present invention can be conventional black-and-white photographic light-sensitive layers, conventional color photographic light-sensitive layers, silver salt diffusion transfer light-sensitive layers, color diffusion transfer light-sensitive layers or the like, for example, as disclosed in *Color: Theory and Imaging Systems*, R. A. Eynard, Editor, SPSE, (1963). With a film assembly containing diffusion transfer light-sensitive materials, it is preferable to provide an image-receiving sheet for receiving the transfer image-forming substance, together with the light-intercepting sheet for covering the support surface of the light-sensitive sheet, between the pressure plate and the rear wall of the film container.

The surface of the light-sensitive layer to be used in the film assembly of the present invention contains a light-absorbent in a hydrophilic colloid in an amount sufficient to prevent, upon exposure, the next light-sensitive sheet lying behind in contact with the light-sensitive sheet to be exposed from being fogged.

The necessary amount of the light-absorbent varies depending upon the purpose of use of the film assembly and the conditions of use. However, in general, the amount is adjusted so that an optical density of not less than 4, preferably not less than 5, is provided over all wavelengths of lights to which the silver halide light-sensitive layers are sensitive. Also, the light-intercepting layer sufficiently possesses an optical density of about 9 for usual uses.

The light-intercepting layer provided on the light-sensitive layer to be used in the present invention must be permeable to a processing solution, the processing solution being used for development-processing the silver halide emulsion. For this purpose, the light-intercepting layer comprises a hydrophilic colloid layer containing light absorbent. This light-intercepting layer also functions to protect the light-sensitive layer, upon withdrawal of the imagewise exposed light-sensitive sheet out of a camera, from ambient light. Furthermore, to use the light-sensitive layer as a photograph, advantageously, after the point in the development processing where the light-sensitive layer is no longer capable of being fogged, the light-intercepting layer itself is removed or is rendered transparent by dissolving the layer away or rendering the light absorbent colorless in the layer.

In the film assembly of the present invention, two or more light-sensitive sheets are superposed one over the other in a face-to-face relationship and sandwiched between the front wall of a container having a rectangular opening (which, of course, also includes a square opening) and a pressure plate. The light-sensitive sheets are maintained in a planar relationship to each other by a compressive force acting between the margin of the opening and the pressure plate, and the film assembly is so designed that, when the assembly is loaded in a camera, the focal plane of the lens coincides with the light-sensitive layer of the light-sensitive sheet in contact with the exposure opening. The light-sensitive sheet is retained in a container with its transparent support being directed toward the opening. Upon photographing, light passing through the exposure opening of the container and reaching the light-sensitive sheet acts on the light-sensitive layer to form a latent image on the silver halide emulsion grains. The light passing through the light-sensitive layer is absorbed by the light-intercepting layer. Thus sufficient light to fog a second light-sensitive sheet lying behind does not leak through.

In the film assembly of the present invention, light-sensitive sheets are superposed one over the other in such manner that the light-intercepting layer comes into contact with a next transparent support, and are fixed through a compressive force as if they were a unitary body. An exposed first light-sensitive sheet is shifted along the front wall without shifting the other light-sensitive sheet or sheets, and is thus removed from the exposure opening. Thus, a second light-sensitive sheet appears at the exposure opening. The foremost light-sensitive sheet is shifted, e.g., by pulling a leader sheet connected to the light-sensitive sheet by pushing or pulling the light-sensitive sheet, by using perforations formed in the sheet and an external element capable of being inserted into the perforations, or by frictionally driving the light-sensitive sheet through rollers in contact with the surface of the light-sensitive sheet. In order to immobilize a second light-sensitive sheet and those lying behind this sheet during the shift of the first sheet, it is useful to adjust the frictional characteristics and compressive force between the light-sensitive sheets, to provide a weak fixing means at the rear end of the light-sensitive sheet or to provide a slit at the fore end which permits the sheets to be passed one by one. The exposed sheet can be shifted through a withdrawing opening formed in the side wall of a container along an imaginary extended plane or can be shifted in a U-form a circuit a round a pressure plate. In the latter shifting method, an exposed sheet is shifted between a pressure plate and a rear wall of a container and can be retained there or can be withdrawn through a withdrawing opening formed in the side wall of the container after combination at that position with a light-intercepting sheet, a diffusion transfer image-receiving sheet or the like. The U-shaped turn of the light-sensitive sheet can be effected in a container of the film assembly or can be effected by withdrawing the light-sensitive sheet through a first side wall opening and, after turning the light-sensitive sheet using a mechanism in the camera, putting the light-sensitive sheet back behind a pressure plate of a container through a second side wall opening.

The front wall and the side wall of the container for the film assembly in accordance with the present invention is made of a light-intercepting material and protects the light-sensitive sheets retained in the container from ambient light before the assembly is loaded in a camera. The rear wall of the container and the pressure plate can also be formed, if desired, of a light-intercepting material. In order to protect the light-sensitive sheets from ambient light before loading in a camera, preferably the exposure opening is covered with a light-intercepting film having approximately the same dimensions as that of the light-sensitive sheets. This light-intercepting film is to be removed, after loading the light-sensitive sheets in a camera and before photographing, using the same method of shifting the light-sensitive sheet from the exposure opening described above.

The pressure plate of the film assembly in accordance with the present invention is preferably movable and connected to the container through an elastic body. With the help of the action of the elastic body, the pressure plate presses the light-sensitive sheets against the front wall of the container and moves the stack of light-sensitive sheets forward to ward the exposure opening as the number of the light-sensitive sheets is reduced.

The characteristic aspects of the film assembly of the invention, the relationship of the engaging members and the behavior or the members will be described below with respect to two specific film assemblies described in the accompanying drawings.

Figure 2:
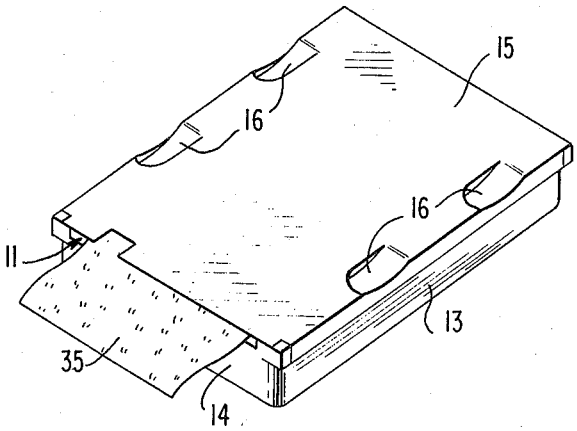
FIG. 2 shows the external appearance of the same film assembly from the back side.

In FIGS. 1 and 2, the container for the film assembly of the present invention is designated by numeral 1. This container 1 comprises front wall 12 having exposure opening 10 for image-wise exposure, three side walls 13 without openings, one side wall 14 having a withdrawal opening 11 for withdrawing an exposed light-sensitive sheet, and rear wall 15. FIG. 1 shows the positional relationship at the stage where a film assembly is loaded in a camera. Light from an object to be photographed passing through lens 100 of a camera forms an image on light-sensitive sheet 30. Extension 35 of a leader sheet for shifting an exposed film from the exposure opening appears at withdrawal opening 11. As seen in FIG. 2, rear wall 15 of the container is equipped with four elastic members 16 for pressing the pressure plate forward.

Figure 3:
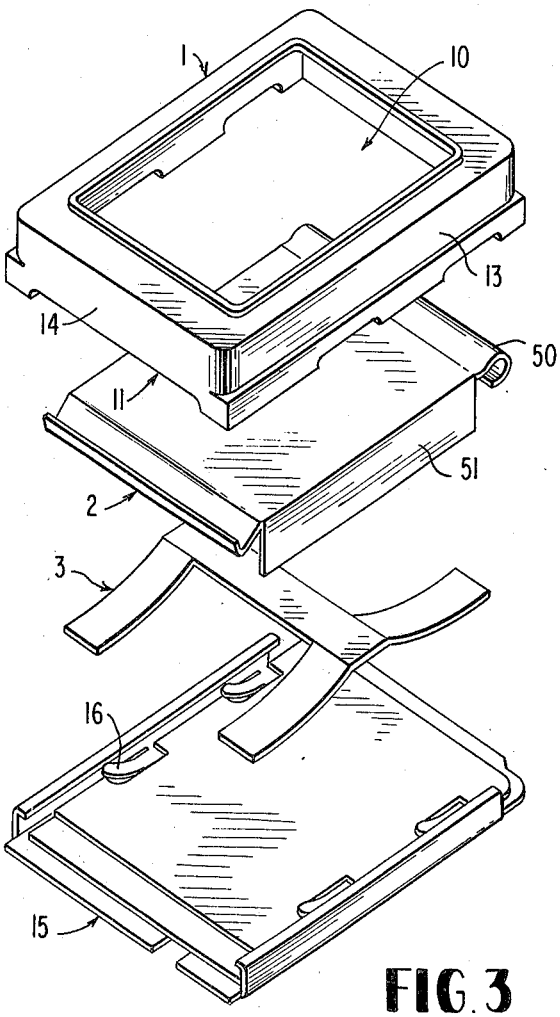
FIG. 3 is a sketch showing the relationship of the assembled parts of the film assembly shown in FIGS. 1 and 2.

FIG. 3 is a broken illustration showing the assembly order of container 1 for the film assembly, shown in FIGS. 1 and 2, pressure plate 2 contained therein and supplementary elastic member 3. Container 1 comprises a first member having a front wall 12 and side walls 13 and 14 and a second member providing a rear wall 15. In this embodiment, the first member can be produced, e.g., by injection-molding a styrene-butadiene copolymer containing carbon black as a light-intercepting material, and the second member is produced by punching, e.g., steel plate and folding to form the shape, then baking a black coating thereon. Projections at the edges of the wall of the first member and the folded portions of the second member are engaged with each other to form a box. Pressure plate 2 is produced and folding, e.g., a steel plate having a black coating baked thereon and possesses a U-shaped projection at one end which facilitate the U-turn of a light-sensitive sheet and skirts 51 at both sides. When the container is assembled, the edges are pushed up by elastic members 16 formed on the rear wall. In order to accept the displacement of elastic member 16, depressions are formed in the edges of the side walls of the container. The compressive force transmitted through skirts 51 serves to push the light-sensitive sheets placed between front wall 12 and pressure plate 2 to thereby maintain the plane of the light-sensitive sheets parallel to the plane of the exposure opening 10. Supplementary elastic member 3 is made of, e.g., a steel plate punched out in an H form and is folded so that the central connecting portion forms a ridge. This supplementary elastic member functions to press a film unit member lying between this and rear wall 15 against the rear wall. The steel plate of rear wall 15 is backed on the inside with a plastic plate, which facilitates the sliding of a film unit out through the withdrawal opening.

Figure 4:
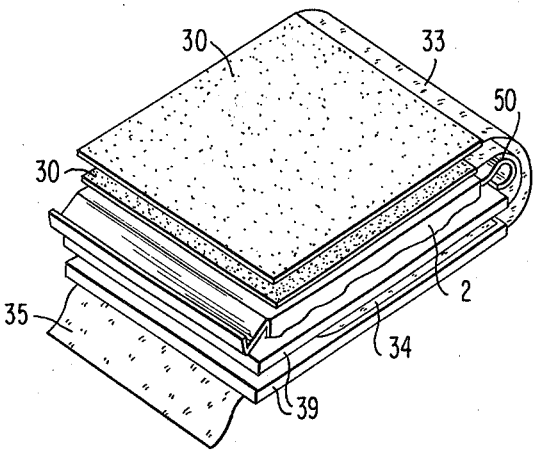
FIG. 4 is a perspective view showing the positional relationship of the film unit in the film assembly shown in FIGS. 1 and 2.

FIG. 4 shows the disposition in which diffusion transfer photographic materials are loaded in the film container shown in FIGS. 1 to 3. For the purpose of facilitating the viewing of the disposition, only two film units are shown. Light-sensitive sheet 30 is connected to leader sheet 33 at one end. The leader sheet penetrates the envelope-like image-receiving sheet/light-intercepting sheet composite 39, an extension 35 of the leader sheet appears at the withdrawal opening. Extension 34 of the leader sheet of a second film unit is weakly connected to the end of the envelope-like composite of the first film unit. These two film units are disposed sandwiching pressure plate 2 having a film-turning end 50.

Figure 5:
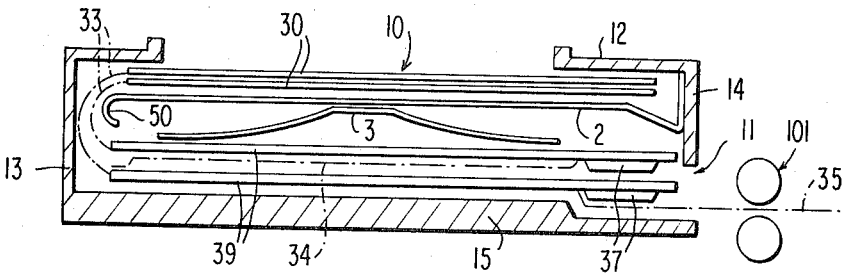
FIG. 5 shows a cross sectional view of the same film assembly shown in FIGS. 1 and 2.

FIG. 5 is a cross sectional view showing the disposition of the same film assembly. Envelope-like composite 39 is pressed against the rear wall by supplementary elastic body 3 to ensure that the composite pass withdrawal opening 11 one by one. When extension 35 of the leader sheet is pulled after imagewise exposure, the light-sensitive sheet 30 of the first film unit is shifted around film-turning edge 50 of pressure plate 2, introduced into a first envelope-like composite 39, and then fixed in a face-to-face relationship with an image-receiving sheet. During this shift, composite 39 is fixed by a click-like stopper (not shown), which is one member of a camera, in order to immobilize the composite. After film unit is unified, the stopper of the camera is released. When the leader sheet is further pulled, the unified film unit (image-receiving sheet/light-intercepting sheet composite containing the light-sensitive sheet introduced therein) reaches pressure-applying rollers 101 fixed to the camera and is passed between the pressure-applying rollers by pulling the leader sheet or by driving the pressure-applying rollers. On this occasion, processing solution container 37 of the film unit is ruptured to release a processing solution between the light-sensitive sheet and the image-receiving sheet, thus diffusion transfer development being initiated. In the unified film unit taken out of the camera, the light-sensitive layer which is being developed is protected from ambient light by a light absorbent-containing hydrophilic colloid layer on the image-receiving layer side and by a light-intercepting sheet on the support side. With the withdrawal of the first film unit, extension 34 of the leader sheet of the second film unit is withdrawn out of the container, followed by cutting the leader sheet from the first film unit.

As the leader sheet, a very strong paper, a resin-processed paper and a thin film of a plastic such as a polyester are suitable.

Figure 6:
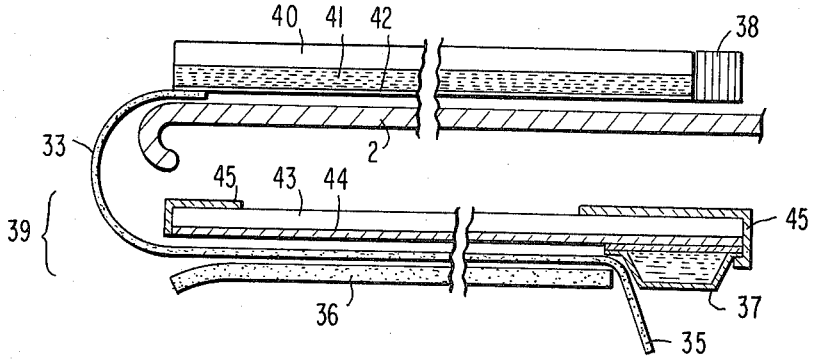
FIG. 6 is a cross sectional view showing the structure of the film unit used therein on an enlarged scale.

FIG. 6 illustrates a detailed cross sectional view showing the structure of the film unit shown in FIGS. 4 and 5. Light-sensitive sheet 30 comprises transparent support 40 having thereon light-sensitive silver halide emulsion layer 41 and light-intercepting layer 42 comprising a light absorbent-containing hydrophilic colloid, with the emulsion-coated surface and the transparent support being directed toward pressure plate 2 and the exposure opening, respectively. Excess solution reservoir 38 for absorbing the excess of the processing solution is provided at the end, which also functions as a stopper when light-sensitive sheet 30 is passed into the image-receiving sheet/light-intercepting sheet composite 39 and is fixed therein at a definite position. Incident light from the transparent support side act on emulsion layer 41 to form an imagewise latent image, and light passing through the emulsion layer are absorbed in the light-intercepting layer. Leader sheet 33 connected to the leading end of light-sensitive sheet 30 passes between the image-receiving sheet and the light-intercepting sheet 36 to reach its end 35. The image-receiving sheet comprises a transparent support 43 having thereon an image-receiving layer 44 which receives the transfer imageforming material released from the silver halide emulsion layer, with image-receiving layer 44 being in contact with the inroduced light-sensitive layer. The image-receiving sheet and the light-intercepting sheet are connected to each other at both sides thereof to form envelope-like composite 39. Rupturable container 37 is fixed with binding member 45 at the leading end of the image-receiving sheet, with this rupturable container retaining a processing solution.

Figure 7:
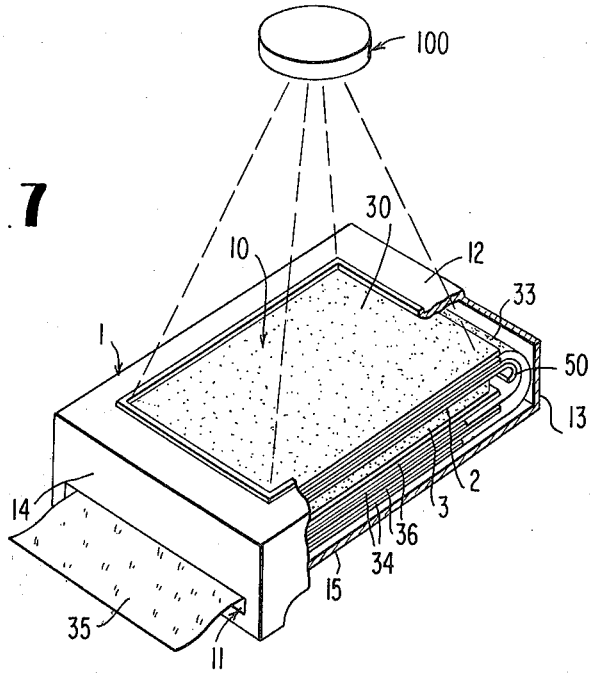
FIG. 7 is a perspective view showing the external appearance of another film assembly of the present invention, wherein the side wall and the upper wall are partly removed to clarify internal position relationship.
Figure 8:
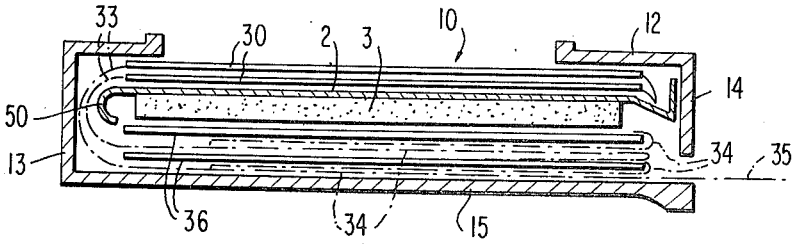
FIG. 8 shows a cross sectional view of the film assembly shown in FIG. 7.

FIG. 7 shows the external appearance of another film assembly in accordance with the invention, in which side walls and front wall are partly removed to show the interior of the assembly. FIG. 8 shows a cross-sectional view of the film materials as they are arranged in film assembly container 1. A container having a front wall 12 with exposure opening wall 10, a side wall having an opening 11 for withdrawing a film unit, three side walls 13 and a rear wall 15 is produced, e.g., from styrene containing carbon black as a light-intercepting material by injection molding and heat sealing. Films are sandwiched in a stack between pressure plate 2 having turning portion 50 and flange 12 of the front wall. In this figure, only two film units are shown. Leader sheet 33 is connected to the leading end of the light-sensitive sheet. This sheet extends to the back side of the pressure plate making a circuit around film-turning portion 50, and its extension 35 appears outside withdrawal opening 11. A light-intercepting sheet 36 lying behind pressure plate 2 is connected, through leader sheet 34, to leader sheet 33 for withdrawing the film unit. The length of the connecting leader sheet is adjusted so that, when leader sheet 34 for withdrawal is fully pulled, the support side surface of the light-sensitive sheet 30 is covered by light-intercepting sheet 36. The light-sensitive sheet of a second film unit lies between that of the first unit and pressure plate 2, while the light-intercepting sheet of the second film unit lies between that of the first film unit and the pressure plate. The head of the leader sheet for withdrawing the second film unit is weakly adhered to the light-intercepting sheet of the first film unit, and the adhesion strength is adjusted so that, upon withdrawal of the first film unit from container 1, the sheet is withdrawn at the same time and, upon just being exposed from the withdrawal opening, the sheet is separated from the first film unit. In order to adhere light-sensitive sheet 30 and image-receiving sheet 34 to each other upon being superposed one over the other compressed in a face-to-face relationship, it is advantageous to apply an adhesive or a precursor thereof to both sheets or one edge of each. As the pressure-applying means to ensure adhesion of both sheets, withdrawal opening 11 of a film assembly container having limited slit width, rollers juxtaposed with a definite clearance, etc. can be advantageously used.

In order to protect the light-sensitive layer withdrawn out of a camera from ambient light crossing the transparent support of the light-sensitive sheet, the edges of the light-sensitive sheet are desirably coated with a light-intercepting coating.

In this film assembly, foamed polymer moldings such as a polyurethane foam can be used behind pressure plate 2 as elastic member 3 which presses light-sensitive sheet 30 toward the exposure opening 10 and the light-intercepting sheet 36 toward the rear wall 15 of the container. The light-sensitive sheet/light-intercepting sheet composite withdrawn out of a camera into a bright place can be processed as such using a series of developing baths. After development processing, the light-intercepting substance can be removed from the light-sensitive sheet and, further, the light-intercepting sheet can be removed to thereby observe and utilize the photographic images formed in the light-sensitive layer.

Examples of light absorbents which can be used in the light-intercepting layer on the light-sensitive layer of the film assembly of the invention are color materials such as dyes and organic and inorganic colored pigments. With color materials which selectively absorb light of a certain wavelength region, it is necessary to mix two or more color materials to attain an absorbance higher than a certain level over the wavelength region of about 350 to 650 m$\mu$, preferably, about 300 to 750 m$\mu$. Since the light-intercepting layer is coated in the vicinity of a silver halide emulsion layer, the light absorbent must be photographically inert. Furthermore, the light absorbent must not diffuse into other layers during the production of the light-sensitive sheet and during storage. Otherwise, the light absorbent would migrate into the silver halide emulsion layer to reduce the light sensitivity or, when applied to a diffusion transfer photographic system, the light absorbent would migrate into the image-receiving sheet to stain the image.

A light absorbent which satisfies the above-described requirements can be selected from among those which have heretofore been used in the production of photographic light-sensitive materials for the purpose of antihalation, for use in a color sensitivity-adjusting filter, or for the purpose of absorbing ultraviolet light. In order to render the light absorbent non-diffusible, a colloidal dispersion of a substance which is insoluble in an aqueous medium and in the medium of a processing composition, dyes which form associations like micelles of a size incapable of migrating through the matrix of the light-intercepting layer, dye connected to a polymer through a covalent bond or non-covalent bond like an ionic bond, or the light-absorbing polymer which contains a conjugated double bond system along the main chain can be used. A polymer layer which contains both a colloidal dispersion of an insoluble light absorbent and a dye rendered diffusion-resistant is particularly useful for the practice of the present invention due to its especially large light-intercepting ability.

Light absorbents particularly useful for the practice of the present invention include the following:

1. Inorganic pigments: carbon (carbon black), a colloidal dispersion of silver or a like metal, manganese dioxide, cobalt oxide, ferric oxide, barium chromate, lead chromate, chromium oxide;

2. Organic pigments: Helio Orange TD, Lithol Rubine BK, Helio Purpurine or a like azo lake; ferric salt of Naphthol AS nitroso derivative or a like nitroso dye lake or nitro dye lake; Fanal Blue B, Fanal Yellow G, Fanal Red 6B extra, Fanal Color Pink BM, Pigment Black or a like basic dye lake; the Ca, Ba or Al salt of Helio Fast Pink, Helio Fast Blue BL or a like anthraquinone dye; a phthalocyanine pigment such as Cu-phthalocyanine;

3. Dyes:

a. Various dyes substantially insoluble in an aqueous medium such as Sudan I, Oil Red CB, Sudan Black B or a like oil-soluble azo dye; indoanilines and indophenols; azomethines obtained by the oxidative coupling between an active methylene compound such as 5-pyrazolone or benzoylacetone and p-phenylene-diamine or p-aminophenol; indigo dyes such as indigo, Bromoindigo 4B, thioindigo, etc.; anthraquinone dyes such as Algol Yellow WG, Indanthrene Red 5GK, Algol Scarlet G, Celliton Fast Blue B, Celliton Fast Blue Green B, etc., Nigrosine dyes such as Oil Black, Brilliant Spirit Black RM, etc.;

b. Azo dyes, azomethine dyes, indoaniline dyes and anthraquinone dyes, having a sulfo group or a carboxy group as a water-solubilizing group and a hydrophobic residue such as an alkyl group having 12 or more carbon atoms, these dyes being dispersed in a hydrophilic polymer as micelles;

c. Basic dyes ionically fixed to anionic polymers having sulfone groups or sulfuric ester residues or to an anionic surface active agent, such as Auramin O, Crystal Violet, Rhodamine 6G or Malachite Green, fixed to polyethylene-p-sulfonic acid or to cetyl sulfate;

d. Precipitates formed from an acid dye and a basic dye, the combination of the acid dye and basic dye being selected so that the mixture appears black (it is particularly advantageous to mix both dyes in a hydrophilic colloid to form precipitate and utilize the mixture directly as a coating solution);

e. Colored polymers obtained by reacting a polymer having hydroxy groups, amino groups or the like with a reactive dye having a chlorotriazine group, a chloropyrimidine group, a vinylsulfone group, a β-hydroxyethylsulfone group, a β-chloropropionylamine group, an acrylamido group, an epichlorohydrin group, an epoxy group, a chloroethylamino group, an ethyleneimine group, etc., for example, the reaction product obtained by reacting gelatin or polyethyleneimine with Procion Brilliant Blue H7GS, Procion Scarlet HRS, Procion Brilliant Orange HGRS, Procion Black HN, Remazol Brilliant Red BB, Levafix Yellow 4GL or Cibacron Blue 3G;

4. Ultraviolet light-absorbing agents: 2-(2-hydroxyphenyl)-benzotriazole derivatives described in U.S. Pat. No. 3,533,794; high molecular weight ultraviolet light-absorbing agents described in Japanese Pat. Publication No. 37332/65 and British Pat. No. 1,146,348; and 5. Colored high molecular weight substances having conjugated double bonds along the main chain.

These light absorbents themselves form a film or are incorporated in a processing composition permeable polymer. An emulsion layer, a light-intercepting layer or an image-receiving layer in the film unit of the present invention is preferably water permeable. Particularly preferred hydrophilic polymers for forming the matrix of the light-intercepting layer include gelatin, gelatin derivatives modified with an acylating agent such as phthalic anhydride, benzenesulfonyl chloride, chloroacetic acid, etc., gelatin grafted with acrylamide or a like vinyl monomer, polyvinyl alcohol, partially hydrolyzed products of polyvinyl acetate, poly-N-vinylpyrrolidone, polyacrylamide, β-hydroxyethyl cellulose, carboxymethyl cellulose, acrylamide or polymethacrylic acid having been subjected to the Hofmann reaction using a hypochlorite, and the like.

The light absorbent can be incorporated in the above-described hydrophilic polymers using various methods. That is, a water-insoluble light absorbent can be dispersed in a polymer aqueous solution as fine particles. This method is suitable for pigments such as carbon black, Cu-phthalocyanine, etc. Water-insoluble and organic solvent-soluble light absorbents can be dissolved in an organic solvent in advance and then emulsified and dispersed in a polymer aqueous solution. This method is suitable for many of the above-described dyes. For this method of dispersion using a solvent, the techniques described in U.S. Pat. Nos. 2,269,158, 2,322,027, 2,304,939 and 2,801,171, which have so far been employed for dispersing photographic couplers, can be utilized. As another method for incorporating the light absorbent in a hydrophilic polymer, the light absorbent can be chemically converted to render it temporarily water-soluble and, after adding it to a polymer aqueous solution, the modified light absorbent is chemically restored to the original water-insoluble form. This method can be applied to an indigo dye or a like vat dye which is easily rendered water-soluble by converting the to a dye reduced form or to an acid sulfite adduct form and is then restored to the insoluble form by oxidation. As an additional method, the light absorbent can be formed in situ in a polymer aqueous solution. For example, azo dyes and indoaniline or azomethine dyes can be produced by a diazonium coupling reaction and an oxidative coupling reaction, respectively. Basic dyes and phosphotungstic acid are reacted with each other. Lake dyes can be precipitated by reacting acidic azo dyes with a barium salt. Black colloidal silver can be produced by reducing a solution or a dispersion of a silver salt.

In some cases, it is advantageous to use nonionic, anionic or amphoteric active agents or a mixture thereof as a dispersing aid upon dispersing the light absorbent in a polymer. Where a basic polymer is used in a dye image-receiving layer, an anionic surface active agent having a hydrophobic residue containing about 16 or more carbon atoms, such as sodium stearyl sulfate, 1-hydroxy-4-sulfo-2-stearylnaphthamide sodium salt or the like is particularly preferred so as not to reduce the mordanting effect.

As the light-intercepting substances to be used in the present invention, a dispersion of carbon or silver is particularly useful due to the great covering power and the photographically inert properties of these materials. Examples of carbon materials, include carbon black, i.e., lamp black, acetylene black, thermal black, channel black or furnace black. Furthermore, those carbon materials which have been modified by subjecting the surface of the carbon particles to an oxidative treatment, an isocyanate-treatment, a surface active agent-treatment, a graft treatment with a vinyl monomer or a like treatment can also be used with advantage. Suitable carbon materials can be selected from among those described in C. L. Mantell; *Carbon and Graphite Handbook* (1968, Interscience) and many commercial examples are available. As the silver colloid, a black silver colloid which has so far been used for the anti-halation layer of conventional photographic materials is suitable. Such a black silver colloid can be prepared according to the processes described in U.S. Pat. No. 2,688,601, West German Pat. No. 1,096,193 and Japanese Pat. Publication No. 27740/68.

In the film unit of the present invention, the light absorbent-containing layer can be either in direct contact with a light-sensitive emulsion layer or in separate relationship therewith separated by a processing composition permeable layer.

In one preferred embodiment of the present invention, the light absorbent-containing layer is desirably equipped with means whereby it can be removed from the surface of the emulsion layer after the completion of the processing. For example, the polymer contained in the layer is maintained in a water-soluble non-cross linked state, or else, a stripping layer is provided between the emulsion layer and the light absorbent-containing layer.

Various photographically useful ingredients can be added to the light absorbent-containing layer. For example, auxiliary developing agents such as p-tolylhydroquinone, 1-phenyl-3-pyrazolidone or the like, stain-preventing agents such as α-cyanoacetophenone, 5-pyrazolone, phenol and derivatives thereof, desensitizers such as pinakryptol yellow, solvents for silver halides such as uracil, and precursors which provide these ingredients upon alkali hydrolysis, can be included.

In the film unit of the present invention, while the thickness of the light absorbent-containing layer varies depending upon the purpose for the use of the film unit and the kind and content of the light absorbent used, the thickness advantageously ranges from about 1 μ to 20 μ, particularly, 2 μ to 10 μ. A layer comprising 1 part by weight of a hydrophilic polymer per 0.1 to 5 parts by weight of carbon black as the light absorbent and having the above-described film thickness possesses the light-intercepting ability necessary for the practice of the present invention. A hydrophilic colloidal layer containing carbon black and, as an auxiliary light absorbent, a dye as illustrated hereinbefore is particularly useful since such illuminates any spot-like light leakages.

Various types of silver halide emulsion layers can be used for the film assembly of the present invention. In addition to conventional photographic systems such as those of the black-and-white photograph type utilizing developed silver images formed in a light-sensitive layer as a result of imagewise exposure and development, and those of the color photograph type utilizing dye images formed in a light-sensitive layer as a result of imagewise exposure and development; the diffusion transfer type system is particularly useful. That is, the silver salt diffusion transfer method in which a soluble silver salt released from the unexposed areas of a light-sensitive emulsion layer is allowed to diffuse into another layer containing physical development nuclei to deposit there, thus forming positive images; the color diffusion transfer method in which soluble and diffusible dyes released from the unexposed areas of a light-sensitive emulsion layer are allowed to diffuse into an image-receiving layer containing a mordant and fixed there to obtain positive dye images; and the color diffusion transfer method in which soluble and diffusible dyes released from the developed areas of a light-sensitive emulsion layer are allowed to diffuse into an image-receiving layer containing a mordant and fixed there to obtain negative dye images are useful. Furthermore, the present invention can advantageously be applied to a photographic system which provides two photographic images (positive and negative) such as the system which simultaneously provides both a negative image of a silver deposit formed in a light-sensitive layer and a positive silver salt transfer image formed in an image-receiving layer and to the method which simultaneously provides both a negative dye image formed in a light-sensitive layer and a positive diffusion transfer dye image formed in an image-receiving layer, as described in U.S. Pat. application Ser. No. 475,489, filed May 31, 1974, now abandoned.

The silver halide emulsion which can be used in the present invention is a colloidal dispersion of silver chloride, silver bromide, silver chlorobromide, silver bromoiodide, silver chlorobromoiodide or a mixture thereof. The halide composition is selected depending upon the purpose for the use of the light-sensitive material and the processing conditions. In particular, a silver bromoiodide emulsion or a silver chlorobromoiodide emulsion containing about 1 mol % to 10 mol % iodide and not more than about 30 mol % chloride and the balance bromide is desirable. Useful silver halide grains have a mean grain size of about 0.1 μ to about 2 μ. For some purposes of use of the light-sensitive material, silver halides having a uniform grain size are preferable. The grains can take a cubic form, an octahedral form or a mixed crystal form. These silver halide emulsions can be prepared according to known conventional processes, e.g., as described in P. Glafkide; *Chimie Photographique*, 2nd Ed., Chapters 18 to 23, Paul Montel, Paris (1957). That is, a soluble silver salt such as silver nitrate and a water-soluble halide such as potassium bromide are reacted with each other in the presence of a solution of a protective colloid such as gelatin and crystals are allowed to develop in the presence of excess silver halide or a solvent for silver halide such as ammonia. As the precipitating method, a single or double jet method or a pAg-controlled double jet method can be employed. Removal of the soluble salts from the emulsion can be effected by washing and dialysis of the cool-set emulsion, by the combination of the addition of a sedimenting agent such as an anionic polymer having sulfone groups, sulfuric ester groups or carboxy groups or an anionic surface active agent and the adjustment of pH, or by the combination of the use of an acylated protein such as phthaloyl gelatin as a protective colloid and the adjustment of pH, to thereby cause sedimentation.

The silver halide emulsions used in the present invention are preferably subjected to chemical sensitization by the heat-treatment using the natural sensitizers contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylenetetramine. Also, emulsions which tend to form a latent image on the surface of the silver halide grains and emulsions which tend to form a latent image inside the silver halide grains as described in U.S. Pat. Nos. 2,592,550, 3,206,313, etc. can be used in the present invention.

The silver halide emulsions used in the present invention can be stabilized with additives such as 4-hydroxy-6-methyl-1,3,3*a*,7-tetrazaindene, 5-nitrobenzimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of the platinum group metals such as the chlorocomplex salt of palladium, and the like are also useful for stabilizing the light-sensitive material of the present invention. Furthermore, the silver halide emulsions used in the present invention can contain sensitizing compounds such as a polyethylene oxide compound.

The silver halide emulsions used in the present invention can possess, if desired, a color sensitivity expanded with optical sensitizing dyes. Useful optical sensitizing dyes include the cyanines, merocyanines, holopolar cyanines, styryls, hemicyanines, and the like. Specific examples of optical sensitizing agents are described in by P. Glafkides supra, Chapters 35 to 41, and M. Hamer; *The Cyanine Dyes and Related Compounds* (Interscience). In particular, cyanines in which a nuclear nitrogen atom is substituted with an aliphatic group having a hydroxy group, a carboxy group or a sulfo group, e.g., those described in U.S. Pat. Nos. 2,503,776, 3,459,553 and 3,177,210, are especially useful for the practice of the present invention.

The processing composition permeable layers which can be used in the present invention such as the silver halide emulsion layer, the dye image providing material-containing layer and the auxiliary layers (e.g., a protective layer, an interlayer, etc.) contain a hydrophilic polymer as a binder. Examples of suitable polymers are gelatin, casein, gelatin modified by an acylating agent or the like, vinyl polymer-grafted gelatin, proteins such as albumin, cellulose derivatives such as hydroxyethyl cellulose, methyl cellulose, carboxymethyl cellulose, etc., polyvinyl alcohol, partially hydrolyzed products of polyvinyl acetate, polyvinyl pyrrolidone, high molecular weight non-electrolytes such as polyacrylamide, polyacrylic acid, partially hydrolyzed products of polyacrylamide, anionic synthetic polymers such as vinyl methyl ether-maleic acid copolymers, N-vinylimidazole-acrylic acid-acrylamide copolymers, and synthetic polymer amphoteric electrolytes such as polyacrylamide having been subjected to the Hoffmann reaction. These hydrophilic polymers can be used alone or in combination. Furthermore, these hydrophilic polymer layers can cotain a latex-like polymer dispersion of hydrophobic monomers such as alkyl acrylates, alkyl methacrylates, etc. These polymers, particularly, polymers having functional groups such as an amino group, a hydroxy group or a carboxy group can be rendered insoluble with various cross linking agents without the loss of the processing composition permeability. Particularly useful cross linking agents include aldehyde compounds such as formaldehyde, glyoxal, glutaraldehyde, mucochloric acid, acrolein oligomer, etc.; aziridine compounds such as triethylenephosphamide described in Japanese Pat. Publication No. 8790/62; epoxy compounds such as 1,4-bis(2′,3′-epoxypropoxy)-diethyl ether described in Japanese Pat. Publication No. 7133/59; active halogen compounds such as 2-hydroxy-4,6-dichloro-s-triazine sodium salt as described in U.S. Pat. No. 3,325,287; active olefin compounds such as hexahydro-1,3,5-triacryl-s-triazine; methylol compounds such as N-polymethylolurea, hexamethylol melamine, etc.; high molecular weight compounds such as dialdehyde starch or 3-hydroxy-5-chloro-s-triazinyl gelatin described in U.S. Pat. No. 3,362,827, etc. These hydrophilic polymer can contain a cross linking-accelerating agent such as a carbonate or resorcin as well as the cross linking agent.

The photographic layers used in the present invention can be coated using various coating methods such as a dip coating method, a roller coating method, an air knife coating method, a bead coating method described in U.S. Pat. No. 2,681,294, a curtain coating method described in U.S. Pat. Nos. 3,508,947 and 3,513,017. In particular, with the light-sensitive elements of a multi-layered structure, it is convenient to coat a number of layers at the same time using a multi-slit hopper as described in U.S. Pat. Nos. 2,761,417, 2,761,418, 2,761,419 and 2,761,791.

In order to facilitate the coating of the photographic layers used in the present invention, the coating composition advantageously contains a variety of surface active agents as coating aids. Useful coating aids include nonionic surface active agents such as saponin, p-nonylphenol ethylene oxide adducts, alkyl ethers of sucrose, glycerin monoalkyl ethers, etc., anionic surface active agents such as sodium dodecylsulfate, sodium p-dodecylbenzenesulfonate, dioctylsulfosuccinate sodium salt, etc., and amphoteric surface active agents such as carboxymethyldimethyllauryl ammonium hydroxide inner salt, "Deriphat 151" trade name of General Mills, betaine compounds as described in U.S. Pat. No. 3,441,413, British Pat. No. 1,159,825 and Japanese Patent Publication No. 21985/71.

In order to facilitate the coating of the photographic layers used in the present invention, the coating composition can contain various thickening agents. For example, in addition to those which increase the viscosity of the coating composition due to their own viscosity such as high molecular weight polyacrylamide, anionic polymers such as cellulose sulfate, poly-p-sulfostyrene potassium salt and acrylic polymers described in U.S. Pat. No. 3,655,407 which exhibit a thickening action due to the mutual relationship with a binder polymer contained in the coating composition can be similarly used.

The silver halide emulsion used in the invention can be combined, if desired, with various dye image-providing materials to provide dye images. One type of preferred dye image-forming materials are the so-called color photographic couplers which are capable of reacting with an oxidized aromatic primary amino color developer to form indoaniline dyes, indophenol dyes, azomethine dyes, azine dyes, etc. As photographic couplers, many compounds are known and are desired in C. E. K. Mees and T. H. James; *The Theory of the Photographic Process*, 3rd Ed., pp.383–394, Macmillan, (1966), and Pelz; *Farbkuppler*, Agfa Mitteilungen (Leverkusen) III, pp.111–175 Springer, (1961), and the like. Photographic couplers suitable for the present invention can be selected from those described in this literature and in the patent art. Of these, the following are particularly useful. As yellow forming couplers, acylacetanilide derivatives, in particular, acylacetanilide derivatives having an acyl group, an aliphatic acyl group, a benzoyl group bearing an alkoxy group, an aryloxy group, an alkyl group, an acylamino group, a halogen atom, an amino group, etc., or an acyl group having a quaternary carbon atom adjacent the carbonyl group, such as a pivaloyl group, are excellent. As substituents for the anilide group, a halogen atom, an alkoxy group, an aryloxy group, an amino group or an alkyl group at one o-position is useful from the viewpoint of absorption of dye. In addition, an acylamino group, a sulfonamido group, a sulfamyl group, an alkoxycarbonyl group, a carbamyl group, a cyclic imido group, a carboxy group, a sulfo group, etc. are useful. Specific examples of yellow-forming couplers which can be advantageously used in the present invention are described in U.S. Pat. Nos. 2,407,210, 2,875,075, 3,409,439, 3,551,155, 3,551,156, 3,649,276, 3,685,995, 3,265,506, 3,277,155, 3,447,928, 3,408,194 and German Pat. OLS No. 2,213,461, etc. Furthermore, one hydrogen atom at the active methylene group of the acylacetanilide compound can be replaced by a halogen atom, an aryloxy group, an arylthio group, a heterooxy group, a heterothio group, an acyloxy group, a sulfonyloxy group, a diacylamino group, an acylsulfonylamino group, etc.

As magenta-forming couplers, the 5-pyrazolone compounds are useful. In particular, 5-pyrazolone compounds having a phenyl group at the 1-position are excellent. As the substituent for the phenyl group, a halogen atom, an alkyl group, an alkoxy group, an aryloxy group, a cyano group, a carbonyl group, a sulfo group, etc. are useful. In particular, substitution with a halogen atom, an alkyl group, an alkoxy group, etc. in at least one o-position is advantageous for stabilizing the images. The pyrazolone ring can be substituted at the 3-position by an alkyl group, an aryl group, an alkoxy group, an amino group, an acylamino group, a ureido group, a sulfonamido group, etc. Specific examples of magenta-forming couplers which can be advantageously used in the present invention are described in U.S. Pat. Nos. 2,439,098, 2,600,788, 3,062,653, 3,558,319, 3,253,924, 3,419,391, 3,311,476, 3,415,652, 3,468,666, British Pat. No. 956,261, German Pat. OLS No. 2,015,867, etc. Furthermore, one hydrogen atom at the 4-position of the pyrazolone ring can be substituted with an arylazo group, a heteroazo group, an arylidene group, an alkylidene group, an aryloxy group, an arylthio group, a heterothio group, an acyloxy group, a carbonic acid ester group, a diacylamino group, etc. Also, the pyrazolone ring can be acylated to form 5-acylpyrazolone. In addition to these compounds, indazolone compounds, benzisoxazole compounds, pyrazolobenzimidazole compounds, 1-H-pyrazolo-[3,2-C]-s-triazole compounds and the like can be used as a magenta-forming coupler in the present invention.

As cyan-forming couplers, phenol compounds and α-naphthol compounds are useful. In particular, phenol compounds substituted with an acylamino group in at least at one of the 2- and the 5-positions and α-naphthol compounds substituted with a carbamyl group at the 2-position are useful. Other non-coupling positions can be substituted with a halogen atom, an alkyl group, an aryl group, an alkoxy group, an aryloxy group, etc. The coupling site in the para-position to the phenolic hydroxy group can be substituted with an arylazo group, a hetero azo group, a halogen atom, an alkoxy group, an aryloxy group, an arylthio group, a heterothio group, a diacylamino group, a sulfo group, etc.

Specific examples of cyan-forming couplers which can be advantageously used in the present invention are described in U.S. Pat. Nos. 2,367,531, 2,369,929, 2,423,730, 2,772,162, 2,895,826, 2,474,293, and 3,591,383.

The couplers combined with an emulsion layer advantageously possess a hydrophobic residue having 8 or more carbon atoms. Representative examples of such residues are a dodecyl group, an oleyl group, a 2,4-di-tert-amylphenyl group, a 3-n-pentadecyl group, etc. These couplers are incorporated in a light-sensitive layer, e.g., by dissolving the coupler in an aqueous medium and adding the solution to a photographic emulsion, or by dissolving the coupler in an organic solvent, emulsifying the solution in an aqueous medium for dispersion in a colloidal state and adding the dispersion to a photographic emulsion.

Where the film assembly of the present invention contains a diffusion transfer color photographic light-sensitive layer, the light-sensitive layer is combined with various dye image-providing materials capable of releasing diffusible ingredients which provide an imagewise distribution of dye as a result of imagewise exposure and subsequent development. As the diffusion transfer dye image-providing materials a dye developer and a diffusible dye-providing coupler are particularly useful for the present invention. As is described in U.S. Pat. No. 2,983,606, the former dye developer is a compound which possesses both a dye structure moiety and a silver halide developing group in the same molecule or in one unit which behaves as one molecule. The dye developer, oxidized with the exposed silver halide under alkaline conditions, is fixed, while the unoxidized dye developer diffuses through an alkaline processing solution into an image-receiving layer. The dye structure moiety is derived from an azo dye, an anthraquinone dye, a phthalocyanine dye, an azomethine dye, an indoaniline dye, an indophenol dye, an azomethine dye, an azine dyes, etc. On the other hand, as the silver halide developing group, a benzenoid developing group, particularly an o- or a p-hydroquinonyl group, is useful. In preferred dye developers, the dye structure moiety and the developing group are connected to each other through a divalent residue incapable of conjugating, such as an alkylene group (e.g., an ethylene group). Furthermore, in the film assembly of the present invention, it is advantageous to reduce the dye structure moiety to thereby temporarily convert the dye to a colorless leuco form as described in U.S. Pat. No. 3,320,063, or to acylate the hydroxy group or amino group of the auxo chrome to thereby temporarily shift the absorption to a shorter wavelength side as described in U.S. Pat. Nos. 3,230,085 and 3,307,947. Specific examples of dye developers which can be advantageously used in the present invention are described in U.S. Pat. Nos. 2,983,605, 2,992,106, 3,047,386, 3,076,808, 3,076,820, 3,077,402, 3,126,280, 3,131,061, 3,134,762, 3,134,765, 3,135,604, 3,136,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790, 3,230,082, etc.

Another type of diffusion transfer dye image-providing materials which can be advantageously used in the present invention are diffusible dye-releasing couplers. This type of coupler is a reactive, non-diffusing compound capable of coupling with an oxidized developing agent and, as a result of the coupling reaction, is capable of eliminating and releasing a dye which is soluble and diffusible in a development-processing composition. This type of coupler contains a structure in which the coupling reaction site is substituted with a residue which is eliminated by the oxidized developing agent. The electron conjugation system of the dye to be released can be either initially incorporated in the coupler or formed by the coupling reaction. The structural moiety which is contained in this type of coupler and which reacts with an oxidized developing agent can be a moiety derived from acylacetanilide, 5-pyrazolone, phenol, α-naphthol, etc. As the bonding group to be introduced into the coupling site of these structural moieties and split off by an oxidized developing agent, there are an azo group, an azoxy group, an oxy group (ether bond), a thio group (thioether bond), a dithio group, a triazolyl group, a diacylamino group, an acylsulfonamino group, an acyloxy group, a sulfonyloxy group, an alkylidene group, etc. Specific examples of diffusible dye-releasing couplers which can be advantageously used in the present invention are described in British Pat. Nos. 840,731, 904,364, 1,085,631, U.S. Pat. Nos. 3,476,563, 3,644,498, 3,419,391.

As the aromatic primary amino developing agents to be used in combination with these couplers, p-aminophenol, p-phenylenediamine and the derivatives thereof are useful. In order to obtain a positive diffusion transfer image, such emulsion systems as a direct positive emulsion, a negative emulsion combined with a physical development nuclei-containing adjacent layer, a DIR coupler-containing negative emulsion combined with an spontaneously developable adjacent layer, and the like are employed.

Dye image-providing materials other than dye developers and diffusible dye-releasing couplers can also be used. For example, transfer dye image-providing materials capable of releasing a diffusible dye through a second reaction as described in U.S. Pat. Nos. 3,585,026, 3,698,197, German Pat. OLS No. 2,242,762 are suitable.

The processing composition used, if desired, in combination with diffusion transfer light-sensitive sheets is a liquid composition containing the processing components necessary for the development of the silver halide emulsion and necessary for the formation of the diffusion transfer dye image. The main solvent therein is water and, in some cases, hydrophilic solvents such as methanol, or methyl cellosolve are additionally present. The processing composition contains alkali in an amount sufficient to maintain the pH at a level necessary for causing development of the emulsion layer and neutralizing acids to be produced during the various steps of development and dye image formation. Suitable alkalis which can be used include sodium hydroxide, potassium hydroxide, calcium hydroxide dispersion, tetramethylammonium hydroxide, sodium carbonate, trisodium phosphate, diethylamine, etc. The processing composition preferably possesses a pH of not less than about 12 at room temperature (e.g., 20°–30° C). More preferably, the processing composition contains a hydrophilic polymer such as high molecular weight polyvinyl alcohol, hydroxyethyl cellulose, sodium carboxymethyl cellulose or the like. These polymers impart a viscosity of not less than 1 poise, preferably about 1000 poise, at room temperature to the processing composition, which not only facilitates the uniform spreading of the composition upon processing but also forms an immovable film, upon concentration of the processing solution due to the migration of the aqueous solvent into the light-sensitive element and the image-receiving element in the course of the processing, thus serving to unify the film unit after processing. In addition, this polymer film can serve, after the substantial completion of the formation of the diffusion transfer dye image, to control further migration of the coloring ingredients into the image-receiving layer, thereby preventing the image from being changed.

In some cases, the processing composition advantageously contains a light absorbent such as carbon black and a desensitizer as described in U.S. Pat. No. 3,579,333 so as to prevent the silver halide emulsion from being fogged by light from the outside during processing. Furthermore, the processing composition advantageously contains processing ingredients specific to the image-providing material used. With a dye developer, auxiliary developing agents such as p-aminophenol, 4′-methylphenylhydroquinone, 1-phenyl-3-pyrazolidone, etc., an onium development accelerator such as N-benzyl-α-picolinium bromide, an antifogging agent such as benzotriazole are the examples of such ingredients and, with diffusible dye-releasing couplers, developing agents such as an aromatic primary amine color developing agent, an antioxidizing agent such as a sulfite or ascorbic acid, an antifogging agent such as a halide or 5-nitrobenzimidazole, a silver halide solvent such as a thiosulfate or uracil are examples of such ingredients.

The processing composition used, if desired, in combination with a diffusion transfer light-sensitive sheet is advantageously retained in a rupturable container. Such a container is advantageously prepared by folding a sheet of a liquid- and air-impervious substance and sealing each edge to form a cavity in which the processing solution is to be retained, and the container is advantageously constructed so that, when the film unit passes through pressure-applying members, the container is ruptured at a given portion due to the inner hydraulic pressure generated within the processing composition to thereby release the contents. A polyethylene terephthalate/polyvinyl alcohol/polyethylene laminate, a lead foil/vinyl chloride-vinyl acetate copolymer laminate or the like can be advantageously used as the substance for forming the container. This container is desirably fixedly positioned and extends transverse a leading edge of the film unit whereby substantially unidirectional discharge of the container's contents on the surface of the light-sensitive element is effected. Preferable examples of such containers are described in U.S. Pat. Nos. 2,543,181, 2,643,886, 3,653,732, 2,723,051, 3,056,491, 3,056,492, 3,152,515, and 3,173,580. These containers are advantageous for the practice of the present invention.

The image-receiving element to be used, if desired, in combination with a diffusion transfer color light-sensitive sheet fixes the dye image-forming materials such as the diffusible dyes, etc. which are to be released in an imagewise distribution from a dye image-providing material associated with the silver halide emulsion. Where dye developers having a hydroquinonyl group or anionic substances such as color dyes having an acidic, water-solubilizing group are used as the dye image-forming material, the image-receiving element preferably contains a basic polymer or a basic surface active agent. As the basic polymer, those which have tertiary or quaternary nitrogen atoms are excellent. More specifically, illustrative examples include poly-4-vinyl-pyridine, a polymer of an aminoguanidine derivative of vinyl methyl ketone as described in U.S. Pat. No. 2,882,156, poly-4-vinyl-N-benzylpyridium p-toluenesulfonate, poly-3-vinyl-4-methyl-N-n-butylpyridium bromide, styrene/N-(3-maleimidopropyl)-N,N-dimethyl-N-(4-phenylbenzylammonium chloride) copolymer as described in British Pat. No. 1,261,925, poly[N-(2-methacryloylethyl)-N,N-dimethyl-N-benzylammonium chloride], etc. As the basic surface active agent, those which possess an onium residue such as a ammonium, sulfonium or phosphonium residue and possess a hydrophobic residue such as a long-chain alkyl group are excellent. Specific examples include N-lauryl-pyridinium bromide, cetyltrimethylammonium bromide, methyl-tri-n-laurylammonium p-toluenesulfonate, methyl-ethyl-cetyl-sulfonium iodide, benzyltriphenylphosphonium chloride, etc. In addition to these basic compounds, multi-valent metals such as thorium, aluminum, zirconium, etc. also exert a fixing action on the anionic dye image-forming metals. These substances advantageously form films together with polymers such as gelatin (in particular acid-processed gelatin), polyvinyl alcohol, polyacrylamide, polyvinyl methyl ether, hydroxyethyl cellulose, N-methoxymethylpolyhexylmethyleneadipamide, poly-vinyl pyrrolidone, etc.

Where the dye image-forming material is one component for forming a dye like a diffusible coupler, the image-receiving layer contains the other coupling component capable of reacting with this component to form a dye, such as a p-phenylenediamine derivative and an oxidizing agent, or a diazonium compound. This type of image-receiving element is described in U.S. Pat. Nos. 2,647,049, 2,661,293, 2,698,244, 2,698,798, 2,802,735, 3,676,124, British Pat. No. 1,158,440, 1,157,507, etc.

The image-receiving element used, if desired, in combination with a silver salt diffusion transfer light-sensitive sheet contains a catalyst which accelerates the reduction a soluble silver complex salt released from the light-sensitive sheet in an imagewise distribution. As such catalyst, silver-precipitating nuclei thus far known as physical development nuclei in photographic chemistry and the precursors thereof are useful. In particular, the metal sulfide colloid as described in U.S. Pat. Nos. 2,698,237, 2,698,238 and 2,828,122, especially, the colloid of silver sulfide, copper sulfide, lead sulfide, cadmium sulfide or zinc sulfide, the colloid of a heavy metal (e.g., silver, gold, palladium, platinum or rhodium), and a metal layer formed by vacuum evaporation as described in U.S. Pat. Nos. 3,234,022 and 3,295,972 are useful. These silver-precipitating nuclei can be either incorporated in a hydrophilic colloid or positioned in a hydrolyzed cellulose ester layer.

The film unit of the present invention can contain a developing agent scavenger which reacts with excess developing agent remaining after the processing to form a colorless product which is difficult to oxidize. In particular, a film unit which contains the above-described scavenger in its acidic substance-containing neutralizing layer, in its neutralization rate-adjusting layer or in its image-receiving layer provides distinct images with less stain. Film units which contain an aromatic primary amine developing agent, tending to cause stain, advantageously contain a compound having a functional group capable of condensing with amines, such as an isocyanate, an aldehyde precursor and a vinylsulfonyl compound described in U.S. Pat. Nos. 3,743,504, 3,730,713, and 3,725,063 as the scavenger.

The diffusion transfer photographic film unit of the present invention preferably possesses the function of neutralizing alkali brought thereinto from a processing composition. The processing composition contains alkali so as to provide a pH of higher than 10, preferably higher than 11, which is high enough to accelerate the image-forming steps comprising the development of the silver halide, the formation of the diffusible dye image-forming material and the diffusion. After the substantial completion of the formation of diffusion transferred images, the pH in the film unit is reduced to around neutrality, e.g., less than 9, preferably less than 8, whereby further image-formation is actually discontinued to prevent the image tone from being changed with the lapse of time and to control discoloration and fading of the images and stains of the white background due to the high alkalinity. For this purpose, it is advantageous to provide in the film unit a neutralizing layer containing an acidic substance in a sufficient quantity to neutralize the alkali contained in the processing composition to the above-described pH, that is, in an area concentration equivalent to or greater than the amount of alkali contained in the spread processing composition. As preferable acidic substances, there are those which contain an acidic group having a pKa of less than 9, particularly a carboxy group or a sulfonic group, or contain a precursor group capable of providing such an acidic group upon hydrolysis. As more preferable examples, there are the higher fatty acids such as oleic acid described in U.S. Pat. No. 2,983,606, polymers of acrylic acid, methacrylic acid or maleic acid, the partially esterified polymers thereof, or acid anhydrides. Specific examples of high molecular weight acidic substances include copolymers of a vinyl monomer (e.g., ethylene, vinyl acetate, vinyl methyl ether, etc.) and maleic anhydride, and the n-butyl half ester thereof; copolymers of butyl acrylate and acrylic acid; cellulose acetate hydrogen phthalate; and the like. In addition to these acidic substances, the neutralizing layer can contain polymers such as cellulose nitrate and polyvinyl acetate, and a plasticizer as described in U.S. Pat. No. 3,557,237. Furthermore, the neutralizing layer can be hardened through cross linking with a multifunctional aziridine compound, an epoxy compound, etc. The neutralizing layer is positioned in the image-receiving element and/or the light-sensitive element. In particular, it is advantageously positioned between the support of the image-receiving element and the image-receiving layer. As is described in U.S. Pat. No. 3,576,625, the acidic substances can be microencapsulated and incorporated in the film unit.

The neutralizing layer or the acidic substance-containing layer which can be used in the present invention is desirably separated from the spread processing composition layer by a neutralization rate-adjusting layer. This neutralization rate-adjusting layer functions to prevent a disadvantageous reduction in the transfer image density due to a too fast reduction in the pH before the necessary development of the silver halide emulsion layer and the formation of the diffusion transfer image are completed. That is, the layer functions to delay the reduction in pH until the necessary development and transfer are completed. In a preferable embodiment of the present invention, the image-receiving element possesses a multi-layered structure comprising a support—a neutralizing layer—a neturalization rate-adjusting layer—a mordant layer (image-receiving layer) in this sequence. The neutralization rate-adjusting layer comprises mainly polymers such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, copolymers of $\beta$-hydroxyethyl methacrylate and ethyl acrylate, and the like. These polymers are usefully hardened through cross linking with an aldehyde compound such as formaldehyde or an N-methylol compound. The thickness of the neutralization rate-adjusting layer preferably is about 2 μ to 20 μ.

In the light-sensitive element used in the present invention, a dye image-providing material is associated with a silver halide emulsion. The combination of the color selectivity of the silver halide emulsion and the spectral absorption of the dye image is appropriately selected depending upon the intended color reproduction. In the reproduction of natural colors according to subtractive color photography, a light-sensitive element having at least two combinations of emulsions having a selective spectral sensitivity in a certain wavelength region with compounds having a selective absorption in the same wavelength region is used. In particular, a light-sensitive element having the combination of a blue-sensitive silver halide emulsion with a compound capable of providing a yellow dye image, the combination of a green-sensitive emulsion with a compound capable of providing a magenta dye image and the combination of a red-sensitive emulsion with a compound capable of providing a cyan dye image is useful. In the light-sensitive element, these combination units of emulsions and dye image-providing materials are coated as adjacent layers or coated by forming each into particles and mixing. A preferable multi-layered structure comprises in sequence from the side to be exposed. A blue-sensitive emulsion, a green-sensitive emulsion and a red-sensitive emulsion. In particular, in the case of high speed emulsions containing iodide, a yellow filter layer can be positioned between the blue-sensitive emulsion and the green-sensitive emulsion. This yellow filter layers contains a yellow colloidal silver dispersion, an oil-soluble yellow dye dispersion, an acidic dye mordanted with a basic polymer, or a basic dye mordanted with an acidic polymer. The emulsion layers are advantageously separated from each other by an interlayer. The interlayer prevents disadvantageous mutual interactions occurring between emulsion layer units having different color sensitivities. The interlayer comprises a polymer containing fine pores and can be a latex of a hydrophilic polymer and a hydrophobic polymer, as described in U.S. Pat. No. 3,625,685 or a polymer whose hydrophilicity is gradually increased by the processing composition, such as calcium alginate, as described in U.S. Pat. No. 3,384,483, as well as a hydrophilic polymer such as gelatin, polyacrylamide, partially hydrolyzed products of polyvinyl acetate, etc. The interlayer can contain an interlayer mutual interaction-controlling agent chosen depending upon the type of the dye image-providing material and the processing solution used. For example, with a dye image-providing material of the type which releases a diffusible dye due to the action of the oxidation product of a developing agent, reducing agents such as ballasted hydroquinone derivatives and ballasted couplers capable of reacting with an oxidation product to fix the oxidation product are effective for preventing a disadvantageous interchange of the oxidation product of a developing agent between emulsion layer units. Furthermore, in order to attain good color reproduction, it is useful, in a system wherein image reversion is effected by dissolution and physical development, to further incorporate physical development nuclei such as metal silver colloid in the interlayer and, in a system wherein image reversion is effected using a development inhibitor-releasing (DIR) compound, it is useful to incorporate a silver halide of low sensitivity and of a fine size, e.g., a particle size below about 0.5 μ, preferably 0.3 μ, in the interlayer.

The support to be used in the present invention is a planar substance which does not undergo serious dimensional change due to the processing composition during processing. In some purposes, rigid supports such as glass plates can be used. However, in general, flexible supports are useful. Suitable flexible supports are advantageously those generally used for photographic light-sensitive materials such as a cellulose nitrate film, a cellulose acetate film, a polyvinylacetal film, a polystyrene film, a polyethylene terephthalate film, a polycarbonate film, etc. Supports having dimensional stability and oxygen impermeability such as a laminate in which a polyvinyl layer is sandwiched between polyethylene terephthalate layers or between cellulose acetate layers is particularly desirable since the laminate serves to provide stable dye images and suffers less stain. In order to facilitate evaporation of moisture contained in the spread processing composition through the support after the processing, it is advantageous to use aqueous vapor permeable support such as is described in U.S. Pat. No. 3,573,044. In order to prevent incident light leakage through the edge of the transparent support to the silver halide emulsion layer during the processing of the film unit in a bright place, the transparent support is desirably colored to such extent that the transmission of light in a direction parallel to the support can be prevented without inhibiting image-wise exposure and observation therethrough. If desired, the support can contain a plasticizing agent such as a phosphoric ester, a phthalic ester, etc., an ultraviolet light absorbing agent such as 2-(2-hydroxy-4-t-butylphenyl)benzotriazole, etc., an anitoxidant such as a hindered phenol, etc. In order to maintain the adhesion between the support and the hydrophilic polymer-containing layer, it is advantageous to provide a subbing layer or to subject the surface of the support to a preliminary treatment such as a corona discharge, an irradiation with ultraviolet light or a flame treatment. The support usually has a thickness of about 20 to 300 μ.

In the present invention, a light-reflecting substance is used in order to form a white background of the dye image to be formed in the image-receiving layer. Suitable light-reflecting substances include titanium dioxide, barium sulfate, zinc oxide, alumina, barium stearate, calcium carbonate, silicon dioxide, zirconium oxide, kaolin, magnesium oxide, etc. These can be used alone or in combination. Such light-reflecting substance can be either initially formed or, as is described in U.S. Pat. Nos. 3,615,421 and 3,620,724, formed in a given position from a precursor distributed in a film unit. The light-reflecting substance can be incorporated in the layer which contains a hydrophilic polymer such as polyvinyl alcohol, gelatin, hydroxypropyl cellulose, polyvinyl pyrrolidone, etc., as a binder. Furthermore, the light-reflecting substance can be compounded in the processing composition so that, upon spreading of the processing composition, the light-reflecting substance is fixed in a dispersed state in a layer of a film-forming polymer such as hydroxyethyl cellulose or carboxymethyl cellulose formed upon the spreading of the processing composition. The combined use of the light-reflecting substance and a fluorescent brightening agent such as a stilbene, a coumarin, a triazine, an oxazole, etc., provides a beautiful white background. In order to protect the silver halide emulsion layer from ambient light during processing, it is advantageous to incorporate, as is described in U.S. Pat. No. 3,647,437, a dye which assumes a colored form at a pH higher than the pKa thereof and becomes colorless at a pH less than the pKa. The light-reflecting substance-containing layer advantageously possesses the light-reflecting substance/binder polymer composition ratio (by weight) of about 0.5 to about 100, and has a dry thickness of about 5 $\mu$ to 50 $\mu$. Also, this layer possesses a reflectivity of not less than about 50%, preferably not less than 70%.

The film unit of the present invention has a rupturable container retaining the processing composition. When pressed by pressure-applying members, this container is ruptured by the internal pressure to release the processing composition in a predetermined manner. A variety of pressure-applying members can be used. In particular, at least one pair of members juxtaposed with a certain gap or clearance is suited for the processing of the film unit of the present invention. A pair of members are fixedly positioned with a certain clearance or oppose one another through a spring or a like elastic body. The members can be rodshaped, freely rotating rollers or motor-driven rollers. Upon passing between a pair of juxtaposed pressure-applying members, the container is ruptured and the processing composition is released and spread between two sheets in the form of a layer. As the juxtaposed pressure-applying members, those described in U.S. Pat. Nos. 3,647,441 and 3,652,281 are advantageously used.

The present invention will now be illustrated in greater detail by reference to the following non-limiting examples of preferred embodiments of the present invention. Unless otherwise indicated, all parts, percents, ratios and the like are by weight.

EXAMPLE 1

On one side of an 80 $\mu$-thick film support of polyethylene terephthalate was coated as a backing layer a 5 $\mu$-thick gelatin layer containing a dispersion of stearic acid amide and 2-(2-hydroxy-4-tert-butylphenyl)benzotriazole and, on the opposite side were coated, in sequence, the following four layers.

1. Polymer acid layer: A 20 $\mu$-thick layer of vinyl methyl ether and maleic anhydride copolymer (Gantrez AN 139; trade name produced by GAF Co., specific viscosity in methyl ethyl ketone: about 1.2) cross linked with the n-butyl half ester of 1,4-bis(2′,3′-epoxypropoxy)butane.

2. Neutralization rate-adjusting layer: A 5 $\mu$-thick n-butyl acrylate/$\beta$-hydroxyethyl methacrylate copolymer (1:3 in molar ratio; molecular weight about 50,000).

3. Silver halide emulsion layer: A layer provided by coating a silver bromoiodide emulsion panchromatically sensitized with the following optical sensitizers (iodide content: 4.5 mol %; mean grain size: 1.1 $\mu$) at a coverage of 25 g silver/m² and 58 g gelatin/m².

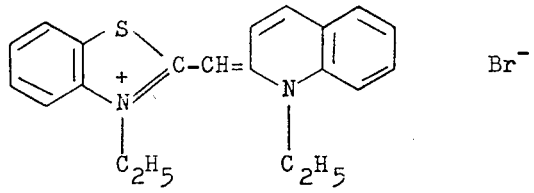

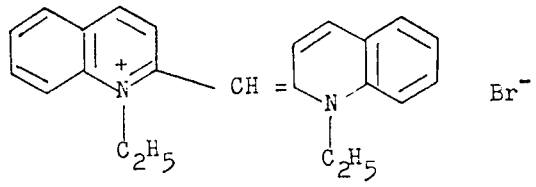

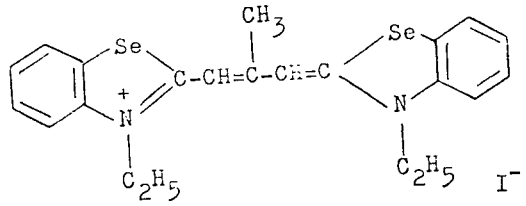

4. Light-intercepting layer (uppermost layer): 300 grams of furnace type carbon black (mean grain size: 27 m$\mu$) was mixed with a mixture containing 600 ml of water, 7.5 g of bis(2-ethylhexyl)-$\alpha$-sulfosuccinate sodium salt and 2.4 g of sodium hydroxide and, after leaving for 24 hours, dispersed using a colloid mill. This dispersion was gradually added to 3750 g of a 40° C aqueous solution containing 750 g of gelatin. This mixture was kneaded for 3 hours at 40° C usng a kneader. The resulting carbon black dispersion was coated in a thickness of 4.5 $\mu$.

Gelatin layers (3) and (4) were hardened with mucochloric acid. Thus, a light-sensitive sheet was prepared.

Then, an image-receiving layer was prepared as follows. A 120 $\mu$-thick cellulose triacetate film support having a 7 $\mu$-thick gelatin layer as a backing layer and plasticized with triphenyl phosphate was immersed for 40 seconds in a hydrolyzing bath (solution temperature: 35° C) having the following composition, and then washed for 4 minutes with running water, followed by drying.

| Hydrolyzing Bath: | |
|---|---|
| Glycerin | 150 g |
| Nickel Nitrate (6 hydrate) | 17 mg |
| Sodium Sulfide (9 hydrate) | 3.1 g |
| Sodium Hydroxide | 120 g |
| Methyl Alcohol | 720 ml |
| Water | 480 ml |

1.2 cm³ of the processing solution having a viscosity of about 30,000 cp and composition was placed in a cavity made by folding a lead foil laminated with a vinyl chloride/vinyl acetate copolymer and sealed by heat-sealing. Preparation and sealing of the solution were conducted under a nitrogen gas atmosphere.

| Processing Solution: | |
|---|---|
| Diethylhydroxylamine | 1.6 g |
| Zinc Chloride | 0.1 g |
| Uracil | 1.2 g |
| Hydroxyethyl Cellulose (highly viscous product) | 0.72 g |
| Potassium Hydroxide | 3.5 g |
| Ethylenethiourea | 1.5 mg |
| Titanium Dioxide | 7.0 g |
| Water | 15 ml |

An envelope-like sheet composite illustrated in FIG. 6 was assembled using the thus prepared image-receiving sheet, the processing solution container and a light-intercepting sheet of a 165 $\mu$-thick cellulose triacetate layer containing 2.5% by weight of carbon black. On this occasion, a laminate film comprising a vacuum-deposited aluminum film sandwiched between polyethylene terephthalate layers containing titanium dioxide was used as a binding member. A polyvinyl acetate layer was provided on the inside of this laminate, which enabled heat-sealing. A leader paper was connected to one end of the prepared light-sensitive sheet, and the extension thereof was passed through the envelope-like composite to complete a film unit. The thus prepared film units were contained in a container to prepare a film assembly as illustrated in FIGS. 1 to 6. The film assembly was designed so that the picture size was a square of 80 mm × 80 mm and the processing solution was spread in a thickness of 100 $\mu$. This film assembly was loaded in a camera and an outdoor scene was photographed at a shutter speed of 1/500th of a second using a lens opening of $f = 16$. After each exposure, the leader paper was pulled to withdraw the exposed film through pressure-applying rollers. These procedures were conducted in the shade. One minute after removing the film from the camera, a black-and-white image was formed. The reflection density was measured to be 1.5 (max) and 0.2 (min). When the same object was photographed and the film was processed in a bright room, the reflection density was 1.6 (max) and 0.2 (min). Thus, substantially the same results were obtained.

EXAMPLE 2

On one surface of a laminate film comprising a 25 $\mu$-thick polyvinyl alcohol film having 38 $\mu$-thick triacetyl cellulose films coated on both sides thereof were coated, in sequence, the following layers to prepare a light-sensitive sheet.

1. A diffusible yellow dye-providing layer containing $1.6 \times 10^{-5}$ mol/100 cm² of a diffusible yellow dye-providing coupler, $\alpha$-pivaloyl-$\alpha$-(3-octadecylcabamylphenoxy)-3,5-dicarboxyacetanilide, 1 mg/100 cm² of t-octylhydroquinone, 12 mg/100 cm² of N,N-diethyllauramide, 0.1 mg/100 cm² of Carey-Lea type gold sol and 16 mg/100 cm² of gelatin, the gold sol being prepared by reducing chloroauric acid with sodium borohydride in the presence of gelatin and appearing pink.

2. A blue-sensitive emulsion layer containing $2.4 \times 10^{-5}$ mol/100 cm² of a yellow-forming coupler, $\alpha$-(2-methylbenzoyl)-2-chloro-5-n-dodecyloxycarbonylacetanilide, 4 mg/100 cm² of di-n-butyl phthalate, 18 mg/100 cm² of gelatin, and blue-sensitive negative type silver bromoiodide emulsion grains (iodide content: 3.0 mol%; mean grain size: 0.9 $\mu$) at a coverage of $14.6 \times 10^{-5}$ mol silver/100 cm².

3. A second diffusible yellow dye-providing layer containing $0.8 \times 10^{-5}$ mol/100 cm² of a diffusible yellow-providing coupler, $\alpha$-pivaloyl-$\alpha$-(3-octadecylcarbamylphenoxy)-3,5-dicarboxyacetanilide, 0.6 mg/100 cm² of t-octylhydroquinone, 6 mg/100 cm² of N,N-diethyllauramide 0.05 mg/100cm² of Carey-Lea type silver sol and 8 mg/100 cm² of gelatin, the silver sol being prepared by reducing silver nitrate with sodium borohydride in the presence of gelatin.

4. An interlayer containing 7.0 mg/100 cm² of Carey-Lea type silver colloid, 5 mg/100² of 2,5-di-t-octylhydroquinone and 13 mg/100² of gelatin.

5. A diffusible magenta dye-providing layer containing $1.0 \times 10^{-5}$ mol/100 cm² of a diffusible magneta dye-providing coupler, 1-phenyl-3-[2-chloro-5-($\alpha$-sulfobutyramido)anilino]-4-[3-N-methyl-N-octadecylcarbamylphenylthio]-5-pyrazolone, 1 mg/100 cm² of t-octylhydroquinone, 7 mg/100cm² of N,N-diethyllaurylamide, 0.1 mg/100cm² of Carey-Lea type silver sol and 13 mg/100 cm² of gelatin.

6. A green-sensitive emulsion layer containing $1.6 \times 10^{-5}$ mol/100 cm² of magenta-forming coupler, 1-(2,6-dichloro-4-methoxy)-3-[3-{$\alpha$-(2,4-di-t-amylphenoxy)-butyramido}phenyl]ureido-5-pyrazolone, 5 mg/100 cm² of tri-o-cresyl phosphate, 16 mg/cm² of gelatin and silver bromoiodide emulsion grains (iodide content: 2.0 mol %; mean grain size: 0.7 $\mu$) sensitized with the following sensitizing agents, at a coverage of $9.3 \times 10^{-5}$ mol silver/100 cm².

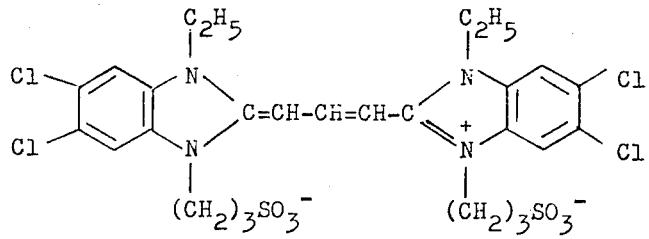

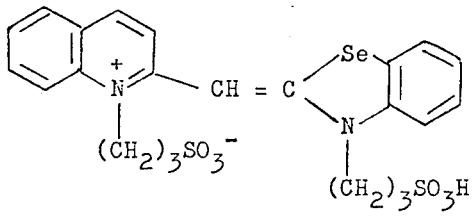

7. A diffusible magenta dye-providing layer containing $0.6 \times 10^{-5}$ mol/100 cm² of a diffusible magenta dye-providing coupler, 1-phenyl-3-[2-chloro-5-($\gamma$-sulfobutyramido)anilino]-4-(3-N-methyl-N-octadecylcarbamylphenylthio)-5-pyrazolone, 0.6 mg/100 cm² of t-octylhydroquinone, 4 mg/100 cm² of N,N-diethyllauramide, 0.06 mg/100 cm² of Carey-Lea type slver sol and 7 mg/100 cm² of gelatin.

8. An interlayer containing 4.0 mg/100 cm² of Carey-

Lea type silver colloid, 5 mg/100 cm² of 2,5-di-t-octylhydroquinone and 13 mg/100 cm² of gelatin.

9. A diffusible magenta dye-providing layer containing $1.2 \times 10^{-5}$ mol 100 cm² of a diffusible cyan dye-providing coupler, 1-hydroxy-4-(3-N-methyl-N-octadecylcarbamylphenylthio)-N:ethyl-2'-methoxy-5'-(γ-sulfobutyramido)-2-naphthanilide, 0.8 mg/100 cm² of n-pentadecylhydroquinone, 8 mg/100 cm² of N,N-diethyllaurylamide, 0.1 mg/100 cm² of Carey-Lea type silver sol and 16 mg/100 cm² of gelatin.

10. A red-sensitive emulsion layer containing $1.8 \times 10^{-5}$ mol/100 cm² of a cyan-forming coupler, 1-hydroxy-N-[γ-2,4-di-t-amylphenoxy)propyl]-2-naphthamide, 4 mg/100 cm² of di-n-butyl phthalate, 14 mg/100 cm² of gelatin and silver bromoiodide emulsion grains (iodide content: 2.0 mol %; mean grain size: 0.7 μ) sensitized with the following sensitizers, at a coverage of $10.8 \times 10^{-5}$ mol silver/100 cm².

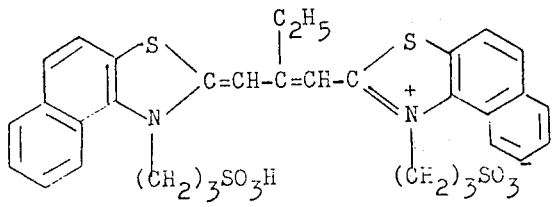

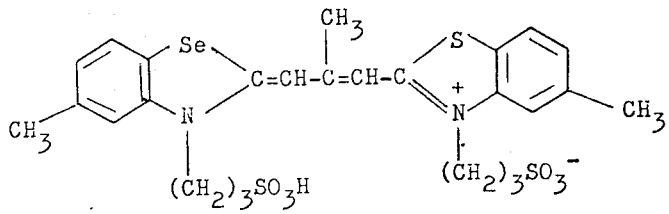

11. A diffusible cyan dye-providing layer containing $0.6 \times 10^{-5}$ mol/100 cm² of a diffusible cyan dye-providing coupler, 1-hydroxy-4-(3-N-methyl-N-octyldecylcarbamylphenylthio)-N-ethyl-2'-methoxy-5'-(γ-sulfobutyramido)-2-naphthoanilide, 0.4 mg/100 cm² of n-pentadecylhydroquinone, 4 mg/100 cm² of N,N-diethyllauramide, 0.05 mg/100 cm² of Carey-Lea type silver sol and 8 mg/100 cm² of gelatin.

12. A mixture comprising 50 g of carbon black (furnace type; mean grain size: 27 mμ), 2.5 g of α-(4-octadecyloxybenzoyl)-2-methoxy-5-sulfo-acetanilide potassium salt, 0.5 g of sodium hydroxide and 150 ml of water was kneaded using a colloid mill to prepare a paste. To this was added 500 g of a 10% aqueous solution of gelatin and, under stirring, a 5% citric acid solution was added thereto to adjust the pH to 5.5. Then, the resulting mixture was coated in a dry thickness of 4.5 μ to complete a light-sensitive sheet. These gelatin layers were hardened with triethylenephosphamide.

Separately, in one surface of a transparent support of a laminate film comprising a 25 μ-thick polyvinyl alcohol film having 25 μ-thick polyethylene terephthalate films coated on both sides were coated, in sequence, the following layers to prepare an image-receiving sheet.

1. A neutralizing transparent layer containing 300 mg/100 cm² of the half ester prepared by treating a vinyl methyl ether-maleic anhydride copolymer (specific viscosity in methyl ethyl ketone: about 1.2) with n-butyl alcohol, 60 mg/100 cm² of 1,4-bis(2',3'-epoxypropoxy)butane and 21 mg/100 cm² of hexahydro-1,3,5-triacryl-s-triazine.

2. A neutralization rate-adjusting layer comprising 45 mg/100 cm² of n-butyl acrylate-β-hydroxyethyl methacrylate copolymer (monomer molar ratio: about 1:1; molecular weight: about 50,000).

3. An image-receiving layer containing 18 mg/100 cm² of cetyl-tri-n-butylammonium chloride, 40 mg/100 cm² of gelatin and 2 mg/100 cm² of tetramethylol urea.

4. The resulting surface was processed with a 1% acetone solution of polyethyleneglycol 1000 monocetyl ether to form a coating film of a thickness about 0.5 μ.

A rupturable container retaining 1 ml of the processing solution having the following composition was prepared. The container was made by folding a laminate film of polyethylene/aluminum/cellophane/polyethylene and heat-sealing so that a cavity for retaining the processing solution was formed.

| | |
|---|---|
| Water | 100 ml |
| Ascorbic Acid | 20 mg |
| 4-Amino-3-methyl-N-ethyl-N-(β-hydroxyethyl)aniline Sulfate (monohydrate) | 2.8 g |
| 6-Nitrobenzimidazole Nitrate | 1.5 mg |
| Sodium Hydroxide | 4.0 g |
| Sodium Carboxymethyl Cellulose | 3.5 g |
| Titanium Dioxide | 45.0 g |

The processing composition was prepared and put into the container under an atmosphere of Freon gas (Freon 12).

Film units were assembled using the resulting light-sensitive sheet, image-receiving sheet and the processing solution container and retained in a container to prepare a film assembly as illustrated in FIGS. 1 to 6.

This assembly was loaded in a camera and an outdoor scene was photographed at a shutter speed of 1/125th of a second using a lens opening of $f = 16$. After each exposure, the leader paper was pulled to withdraw a photographed film through pressureapplying rollers. These procedures were conducted under direct sunlight. Formation of a transfer dye image was observed through the support of the image-receiving sheet. The reflection density was measured to obtain the following results: blue light density: 1.3 (max) and 0.2 (min); green light density: 1.5 (max) and 0.2 (min); red light density: 1.3 (max) and 0.2 (min).

Even in the extreme case of directly photographing the sun, light leakage to an underlying film never occurred, and second and the lower films provided satisfactorily recorded images.

EXAMPLE 3

A transparent, 120 μ-thick cellulose triacetate film was used as a support and the the following layers coated thereon.

1. Blue-sensitive emulsion layer: A layer containing 1.02 g silver/m² of a blue-sensitive silver bromoiodide emulsion grains (iodide content: 6.0 mol %; mean grain size: 1.1 μ), 2.36 m mol/m² of α-(4-methoxybenzoyl)-α-(5,5-dimethyl-3-hydantoinyl)-aceto-2-chloro-5-[α-(2,4-di-t-amylphenoxy)butyramido]anilide, 95 mg/m² of n-pentadecylhydroquinone, 0.8 g/m² of di-n-butyl phthalate and 6.0 g/m² of gelatin.

2. Yellow filter layer: A layer containing yellow Carey-Lea type silver colloid at a coverage of 70 g silver/m² and 2.5 g gelatin/m².

3. Green-sensitive emulsion layer: A layer containing 1.49 g silver/m² of a green-sensitive silver bromoiodide grains (iodide content: 4.5 mol %; mean grain size: 0.9 μ), 1.73 m mol/m² of 1-(2,4,6-trichlorophenyl)-3-(2-chloro-5-myristoylamidoanilino)-5-pyrazolone, 21 mg/m² of 2,5-di-t-amylhydroquinone, 0.5 g/m² of tri-n-hexyl phosphate and 3.8 g/m² of gelatin.

4. Interlayer: A layer containing 43 mg/m² of 2,5-di-t-amylhydroquinone, 0.19 g/m² of di-n-butyl phthalate and 1.5 g/m² of gelatin.

5. Red-sensitive emulsion layer: A layer containing 0.90 g silver/m² of silver bromoiodide grains (iodide content: 4.5 mol %; mean grain size: 0.9 μ), 2.07 m mol/m² of 4,6-dichloro-5-methyl-2-[α-(2,4-di-t-amylphenoxy)butyramido]phenol, 0.8 g/m² of di-n-butyl phthalate and 3.8 g/m² of gelatin.

6. Light-intercepting layer (uppermost layer): A layer provided by coating, in a thickness of 10 μ, a black silver colloid dispertion which was prepared according to Example 2 of Japanese Patent Publication No. 27740/68 in which a silver halide is reduced using hydroquinone and sodium borohydride and contained 2.5 g of silver and 5.0 g of gelatin per 100 g.

These layers were hardened with 2,4-dichloro-6-hydroxy-s-triazine sodium salt.

This reversal film was used as light-sensitive sheet 30 of the film assembly illustrated in FIGS. 7 and 8. In this case, a 165 μ-thick cellulose triacetate film containing 2.5% by weight carbon black was used as a light-intercepting sheet. Before placing the sheets into the film container, a dispersion encapsulating two ingredients of a contact reaction-type adhesive was coated along the margins of the transparent support of the light-sensitive sheet and the light-intercepting sheet without covering the photograph.

This film assembly was loaded in a camera and an outdoor scene was photographed at a shutter speed of 1/125th of a second using a lens opening of $f = 11$. After each exposure, the leader paper was pulled to withdraw the exposed film out of the camera. These procedures were conducted in the shade.

The thus exposed films were subjected to the following development processing in a bright room.

| Processing Step | Temperature | Time |
|---|---|---|
| Hardening Bath | 38° C | 1 |
| Washing | " | 1 |
| First Development | " | 3 |
| Washing | " | 0.5 |
| Reversal Exposure (uniform exposure of 800 lx . sec to emulsion-coated surface) | | |
| Second Development | " | 4 |
| Washing | " | 1 |
| Bleaching | " | 1 |
| Washing | " | 0.5 |
| Fixing | " | 1 |
| Washing | " | 1 |

The processing solutions used had the following compositions

| | |
|---|---|
| Hardening Bath: | |
| Sulfuric Acid (diluted 1:1 by volume with water) | 5.4 ml |
| Sodium Sulfate | 150 g |
| Sodium Acetate | 20 g |
| Pyruvic Aldehyde (30% aqueous solution) | 15 ml |
| Formalin (37% aqueous solution) | 20 ml |
| Water to make | 1 liter |
| First Developer: | |
| 4-(N-Methylamino)-phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to make | 1 liter |
| Second Developer: | |
| Benzyl Alcohol | 5 ml |
| Sodium Sulfite | 5 g |
| Hydroxylamine Sulfate | 2 g |
| 4-Amino-3-methyl-N-methyl-N-(β-methanesulfonamidoethyl)-aniline Sesquisulfate Monohydrate | 1.5 g |
| Potassium Bromide | 1 g |
| Trisodium Phosphate | 3 g |
| Sodium Hydroxide | 0.5 g |
| Ethylenediamine (70% aqueous solution) | 7 ml |
| Water to make | 1 liter |
| Bleaching Solution: | |
| Potassium Ferricyanide | 100 g |
| Sodium Acetate | 40 g |
| Glacial Acetic Acid | 20 ml |
| Potassium Bromide | 30 g |
| Water to make | 1 liter |
| Fixing Solution: | |
| Sodium Thiosulfate | 150 g |
| Sodium Acetate | 70 g |
| Sodium Sulfite | 10 g |
| Potassium Alum | 20 g |
| Water to make | 1 liter |

After development processing and drying, the light-sensitive sheet was separated from the light-intercepting sheet to obtain a color positive image.

Even in photographing outdoor bright objects, images were well separated from each other and the former image was not observed on the next images as a ghost image.

A standard color chip was photographed outdoors under the same conditions as above. In the first photographing, the film was taken out of the camera outdoors and processed in a bright room, while in the second photographing, the camera was brought into a dark room after photographing outdoors, and withdrawal and processing of the film were conducted in a dark room. Thus, the results tabulated below were obtained.

Color Reproduction of Reversal Color Film

| Manner of Handling After Photo-Graphing | Maximum Density (Black Areas) | | | Minimum Density (White Areas) | | |
|---|---|---|---|---|---|---|
| | R | G | B | R | G | B |
| (1) Handled in a Bright Place | 3.35 | 3.45 | 3.30 | 0.12 | 0.10 | 0.16 |
| (2) Handled in A Dark Room | 3.42 | 3.45 | 3.25 | 0.12 | 0.11 | 0.17 |

Filter used for measuring optical density (transmission peak);
R = 680 mμ,
G = 540 mμ,
B = 455 mμ

From the above results, it is demonstrated that, as compared with the conventionally used photographing apparatus, the film assembly of the present invention provides the convenience that films can be taken out after every exposure on the spot and immediately development-processed in a bright place with the photographic characteristics being maintained at the same level.

EXAMPLE 4

On a transparent, 120 $\mu$-thick cellulose triacetate film were coated, in sequence, the following three layers to prepare a panchromatic black-and-white negative film.

1. Emulsion layer: A silver bromoiodide emulsion (iodide content: 5.5 mol%; mean grain size: 0.85 $\mu$) sensitized by the three optical sensitizers described in Example 1 was coated at a coverage of 8.7 g silver/m$^2$ and 19 mg/m$^2$. This emulsion was hardened by incorporating 5% by weight, based on the gelatin, of 4-chloro-6-hydroxy-s-triazinyl-2-gelatin according to the procedures described in Example 1 of U.S. Pat. No. 3,362,827.

2. A hardener-free gelatin layer at a coverage of 13 g/m$^2$.

3. 25 grams of carbon black previously moistened with 50 ml of water was added incrementally to 650 ml of an aqueous solution containing 50 g of gelatin, 0.5 g of sorbitan monolaurate and 0.5 g of 1-hydroxy-4-sulfo-N-stearyl-2-naphthoamide sodium salt and adjusted to a pH of 9.7 with sodium hydroxide. The resulting dispersion was stirred at 45° C for 12 hours in a kneader to finely disperse the carbon black. After adding thereto 10 ml of an aqueous solution containing 0.3 g of sodium p-dodecylbenzenesulfonate as a coating aid, the dispersion was applied in various thicknesses. This light-intercepting layer did not contain a hardener.

This negative film was used as light-sensitive sheet 30 of the film assembly illustrated in FIGS. 7 and 8. On this occasion, an acetone solution of polyvinyl butyral containing 5% by weight of carbon black was coated on the edges of the negative film cut in a rectangular form to intercept light. The light-intercepting sheet used in the film assembly was a 165 $\mu$-thick cellulose triacetate film sheet containing 2.5% by weight of carbon black. Before placing the light-sensitive sheet and the light-intercepting sheet into the film container, a dispersion containing two encapsulated ingredients of a contact reaction-type adhesive was coated along the margins of the transparent support of the light-sensitive sheet and the light-intercepting sheet without covering the photograph. This adhesive layer served to combine both sheets upon withdrawal and passage of the film unit through pressure-applying members to thereby ensure interception of light outside the camera.

This film assembly was loaded in a camera, and an outdoor scene was photographed at a shutter speed of 1/125th of a second using a lens opening of $f = 11$. After each exposure, the leader paper was pulled to withdraw the exposed film out of the camera.

The film units withdrawn from the camera were subjected to the following development processings. The exposure index corresponding to ASA 200 was suitable.

| | | |
|---|---|---|
| (1) Development | 20° C | 12 min |
| (2) Fixing | 20° C | 5 min |
| (3) Washing | 16° C | 5 min |
| (4) Dissolving away the Light-Intercepting Layer | 45° C | 3 min |
| (5) Drying | | |
| (6) Delamination of the Light-Intercepting Sheet | | |

Solutions having the following compositions were used for the above-described processings. The light-intercepting layer was removed by flowing warm water against the light-intercepting layer.

| | |
|---|---|
| Developer: | |
| p-Methylaminophenol Sulfate | 2.0 g |
| Sodium Sulfite (anhydrous) | 100.0 g |
| Hydroquinone | 5.0 g |
| Borax | 2.0 g |
| Water to make | 1 liter |
| Fixing Solution: | |
| Sodium Thiosulfate (penta hydrate) | 240 g |
| Sodium Sulfite (anhydrous) | 10 g |
| Sodium Bisulfite (anhydrous) | 25 g |
| Water to make | 1 liter |

As a result, a transparent negative suitable to be combined with a black-and-white printing paper was obtained.

The sun was directly photographed using negatives having a carbon black gelatin layer of a different thickness, and all of the negative film sheets piled in the container were taken out in a dark room and developed. Thus the following results were obtained.

| Run No. | Film Thickness of Light-Sensitive Layer | Absorbance* | Number of Exposed Sheets |
|---|---|---|---|
| 1 | 2.1 $\mu$ | 3.7 | 3 |
| 2 | 3.0 | 5.4 | 2 |
| 3 | 3.8 | More than 6 | 1 (only the uppermost first sheet) |
| 4 | 4.8 | More than 6 | 1 (only the uppermost first sheet) |

*Diffused light transmission density (measured by using a Macbeth densitometer, DT-504)

Even under the extremely severe conditions of directly photographing the sun, light-intercepting layers of Run Nos. 3 and 4 prevented the superposed negative sheets from being multiexposed. In addition, they showed sufficient permeability for the processing solution to provide normal photographic properties.

While the invention has been described in detail and with reference to specific embodiments thereof, it will be apparent to one skilled in the art that various changes and modifications can be made therein without departing from the spirit and scope thereof.

What is claimed is:

1. A photographic film assemblage comprising in combination a container insertable in and removable from a photographic exposure apparatus for enclosing a plurality of light-sensitive sheets stacked in planar parallel relation and including a forward wall having a rectangular opening to permit exposure of the forwardmost light-sensitive sheet, and a withdrawal opening permitting withdrawal of said light-sensitive sheets following exposure thereof within said container;

a pressure plate located within said container maintaining the plane of the light-sensitive sheets parallel to the plane of the rectangular opening.

a plurality of light-sensitive sheets, each of which comprises a transparent support having thereon, in sequence, at least one silver halide light-sensitive emulsion layer and a light-intercepting layer of a hydrophilic colloid containing a light absorbent in an amount necessary to prevent, upon exposure, any light-sensitive sheet lying behind the forwardmost light-sensitive sheet from being fogged, said light-sensitive sheet being retained in the container such that the support is directed toward said rectangular opening;

a plurality of light-intercepting sheets for covering the support surface of an exposed light-sensitive sheet substantially the same size as the light-sensitive sheets and possessing a light-absorbency necessary to protect the light-sensitive sheets from ambient light outside the exposure apparatus and said light-intercepting sheets being retained between the pressure plate and the rear wall of said container;

means for shifting exposed light-sensitive sheets and for shifting and superimposing said light-intercepting sheets on said light-sensitive sheets after exposure.

2. The film assembly as described in claim 1, wherein the photographic film container possesses four light-intercepting side walls which protect the light-sensitive sheets from light in the lateral direction.

3. The film assembly as described in claim 1, including an adhesive capable of providing light-intercepting connection coated on either or both of the support surface of the light-sensitive sheet and the light-receiving sheet to be in contact.

4. The film assembly as described in claim 1, wherein the edges of the transparent support of the light-sensitive sheets are covered by a light-intercepting layer.

5. The film assembly as described in claim 1, wherein said light-intercepting layer possesses an absorbance corresponding to an optical density of 5 or greater over the entire wavelength region of light to which the light-sensitive layer is sensitive.

6. The film assembly as described in claim 1, wherein said light-intercepting layer possesses an absorbance corresponding to an optical density of 5 or greater over the entire wavelength region of 300 to 750 $\mu$.

7. The film assembly as described in claim 1, wherein the light-intercepting layer can be removed by dissolving or delamination or whose light-absorbance can be removed in an after-treatment.

8. The film assembly as described in claim 1, wherein the light-intercepting layer contains, as a light absorbent, colloidal carbon or colloidal silver.

9. The photographic film assemblage of claim 1 wherein said light-intercepting sheets are connected to said light-sensitive sheets by means of a leader.

10. A film assemblage adapted to produce a plurality of diffusion transfer color prints, which contains (A) a plurality of film units and (B) a photographic film container insertable in and removable from a photographic exposure apparatus for enclosing said plurality of film units and including a forward wall having a rectangular opening to permit exposure of the forwardmost film unit and a withdrawal opening permitting withdrawal of said film unit following exposure thereof within said container;

said film unit (A) containing:

a. a light-sensitive sheet comprising a transparent and flexible support having thereon, in sequence, at least one silver halide emulsion layer and a light-intercepting layer of a hydrophilic colloid containing a light-absorbent in an amount necessary to prevent upon exposure fog formation in any light-sensitive sheet lying behind the light-sensitive sheet of the forwardmost film unit, b. an image-receiving sheet comprising a transparent support having thereon an image-receiving layer capable of fixing a diffusible image-forming substance imagewise released from the light-sensitive sheet as a result of imagewise exposure and development.

c. a light-intercepting sheet for covering the support surface of an exposed light-sensitive sheet, which is substantially the same size as that of the light-sensitive sheet and has an absorbency necessary to protect the light-sensitive layer from ambient light outside the exposure apparatus and d. a container, rupturable by pressure-applying members, which retains processing solution capable of causing development of the light-sensitive layer and the movement of an image-forming substance and which is positioned such that the contents can be released between the light-sensitive layer and the image-receiving layer;

said light-sensitive sheet, said image-receiving sheet and said light-intercepting sheet are connected to each other through a leader sheet in such a manner that an exposed light-sensitive sheet can be interposed between the connected image-receiving sheet and light-intercepting sheet by pulling said leader sheet, thereby unifying the three sheets in a face-to-face relationship and, said processing solution container is positioned on the leader sheet such that the contents of said container can be released between the light-sensitive sheet and the image-receiving sheet;

said photographic film container (B) containing:

e. a pressure plate which maintains the plane of the superposed light-sensitive e sheets parallel to the plane of the exposure opening, with the transparent support being directed toward the exposure opening, f. a cavity between the pressure plate and the rear wall of said container for retaining the image-receiving sheet and the light-intercepting sheet, said image-receiving sheet and said light-intercepting sheet residing in said cavity prior to the exposure of said light-sensitive sheet.

11. The film assembly as described in claim 10, wherein said silver halide emulsion layer is combined with a dye developer and said image-receiving layer contains a mordant capable of fixing a reduced dye developer.

12. The film assembly as described in claim 10, wherein said silver halide emulsion is combined with a non-diffusible dye image-providing material capable of releasing a diffusible dye by reaction with an oxidized product of the developing agent and said image-receiving layer contains a mordant capable of fixing said diffusible dye.

13. The film assembly as described in claim 10, wherein the film units contain physical development nuclei in the image-receiving layer, a solvent for silver halide and a silver halide developing agent.

14. The film assembly as described in claim 10, wherein one image-receiving sheet and one light-intercepting sheet are bonded to each other at their margins to form an envelope, and an exposed light-sensitive sheet is adapted to be moved into said envelope making a U-turn around the pressure plate, the thus unified film unit being passed through the withdrawal opening and pressure-applying members to be processed.

* * * * *